US011289285B2

(12) United States Patent
Uozumi et al.

(10) Patent No.: US 11,289,285 B2
(45) Date of Patent: Mar. 29, 2022

(54) SWITCHING DEVICE

(71) Applicant: ALPS ALPINE CO., LTD., Tokyo (JP)

(72) Inventors: Takeki Uozumi, Wuxi (CN); Toru Nishioka, Tokyo (JP); Toshihisa Matsushita, Niigata (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/105,764

(22) Filed: Nov. 27, 2020

(65) Prior Publication Data

US 2021/0082641 A1 Mar. 18, 2021

Related U.S. Application Data

(63) Continuation of application No. PCT/JP2019/006890, filed on Feb. 22, 2019.

(30) Foreign Application Priority Data

May 29, 2018 (JP) ..... JP2018-102721

(51) Int. Cl.

*H01H 13/30* (2006.01)
*H01H 13/10* (2006.01)
*H01H 13/14* (2006.01)

(52) U.S. Cl.

CPC ..... *H01H 13/30* (2013.01); *H01H 13/10* (2013.01); *H01H 13/14* (2013.01); *H01H 2225/014* (2013.01)

(58) Field of Classification Search

CPC ..... H01H 13/26; H01H 13/28; H01H 5/00; H01H 5/08; H01H 1/36; H01H 13/12;
(Continued)

(56) References Cited

U.S. PATENT DOCUMENTS 8,633,412 B2 1/2014 Mori et al.
10,867,760 B2 * 12/2020 Chen ..... H01H 13/10
(Continued)

FOREIGN PATENT DOCUMENTS

JP 3169859 U 8/2011
JP 5006971 8/2012
WO 2016/136225 9/2016

OTHER PUBLICATIONS

International Search Report for PCT/JP2019/006890 dated Apr. 9, 2019.

*Primary Examiner* — Ahmed M Saeed
(74) *Attorney, Agent, or Firm* — IPUSA, PLLC

(57) ABSTRACT

A switching device includes a housing, an operation member, a plurality of fixed contacts, a plurality of movable contacts, and a snap action mechanism for causing the movable contacts to operate. The snap action mechanism includes a plurality of first drivers in each of which a fulcrum that serves as a pivot point is formed on one end side of a given first driver and in which a given movable contact from among the movable contacts is provided on another end side of the given first driver; a second driver in which a pressing member to be pressed through the operation member is formed on one end side of the second driver and in which fulcrums that serve as pivot points are each formed on another end side of the second driver; and a coupling member integrally coupling the plurality of first drivers to constitute a first drive member.

20 Claims, 29 Drawing Sheets

(58) Field of Classification Search
CPC ..... H01H 13/18; H01H 13/30; H01H 3/16; H01H 13/10; H01H 5/06; H01H 3/00; H01H 13/36; H01H 13/20; H01H 13/14; H01H 23/12; H01H 21/40; H01H 13/42; H01H 1/40
See application file for complete search history.

(56) References Cited

U.S. PATENT DOCUMENTS

| | | | | |
|---|---|---|---|---|
| 2011/0147186 | A1* | 6/2011 | Mori | H01H 13/18 200/468 |
| 2017/0125189 | A1* | 5/2017 | Domzalski | H01H 9/041 |
| 2017/0372851 | A1* | 12/2017 | Tsukanaka | H01H 21/42 |

* cited by examiner

SWITCHING DEVICE

CROSS-REFERENCE TO RELATED APPLICATION

This application is a continuation application of International Application No. PCT/JP2019/006890 filed on Feb. 22, 2019, and designated the U.S., which claims priority to Japanese Patent Application No. 2018-102721, filed on May 29, 2018, the entire contents of which are incorporated herein by reference in their entirety.

BACKGROUND

1. Field of the Invention

The present disclosure relates to a switching device.

2. Description of the Related Art

Switching devices have been proposed to include a plurality of fixed contacts that are juxtaposed at a predetermined interval, a plurality of movable contacts each having contact portions that are in sliding contact with a given fixed contact, and a snap action mechanism that causes the movable contacts to operate when an operation member is pressed to a predetermined position. With such a configuration, multiple circuits can be synchronized and changed over accordingly to ensure redundancy, thereby providing a switching device with superior long life (see, Japanese Patent No. 5006971, which hereinafter referred to as Patent document 1).

SUMMARY

A switching device according to one embodiment includes a housing including an accommodating portion; an operation member through which a press operation is performed; a plurality of fixed contacts juxtaposed at a predetermined interval in the accommodating portion; a plurality of movable contacts each including at least one contact portion that is in sliding contact with a given fixed contact from among the fixed contacts; and a snap action mechanism for causing the movable contacts to operate in response to a pressing of the operation member to a predetermined position. The snap action mechanism includes a plurality of first drivers in each of which a fulcrum that serves as a pivot point is formed on one end side of a given first driver and in which a given movable contact from among the movable contacts is provided on another end side of the given first driver; a second driver in which a pressing portion to be pressed through the operation member is formed on one end side of the second driver and in which fulcrums that serve as pivot points are each formed on another end side of the second driver; a coupling member integrally coupling the plurality of first drivers to constitute a first drive member; and an extension spring of which one end is attached to a portion of the first drive member and another end is attached to a portion of the second driver. The coupling member includes clamping portions each of which passes through holes provided through a given first driver and a given movable contact and each of which clamps the given first driver and the given movable contact.

DESCRIPTION OF THE EMBODIMENTS

With respect to the switching device described in Patent document 1, the inventors of this application have recognized that metal fatigue is accumulated in the surroundings of the contact portions of each movable contact, due to shock generated when the circuits are changed over, and thus, the life of the switching device may be affected.

In view of the problem recognized by the inventors, the present disclosure has an objective to provide a long-life type switching device that further increases a fatigue limit of a movable contact.

According to one or more embodiments described below, a long life-type switching device that further increases a fatigue limit of a movable contact can be provided.

First Embodiment

The first embodiment according to the present disclosure will be described hereinafter with reference to the accompanied drawings.

Figure 1:
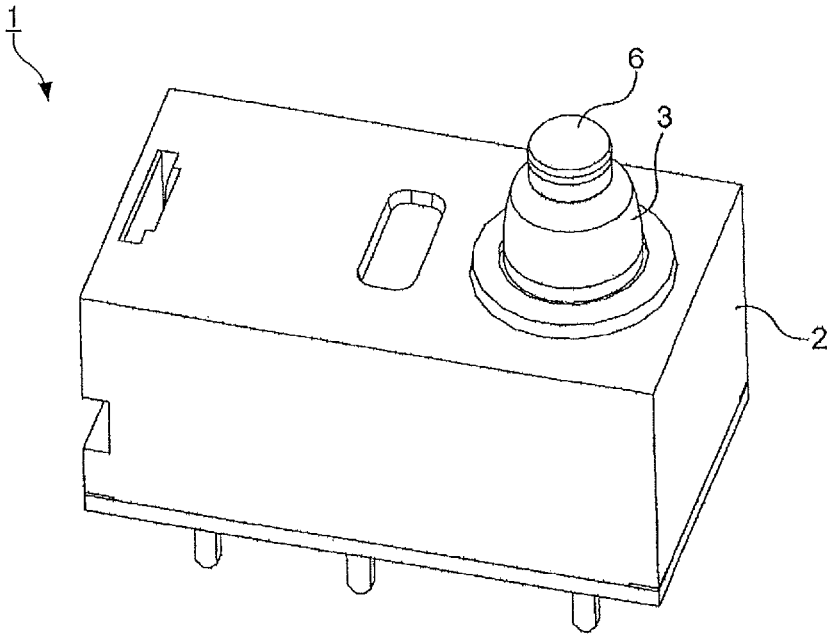
FIG. 1 is a perspective view illustrating the appearance of a switching device according to a first embodiment of the present disclosure.
Figure 2:
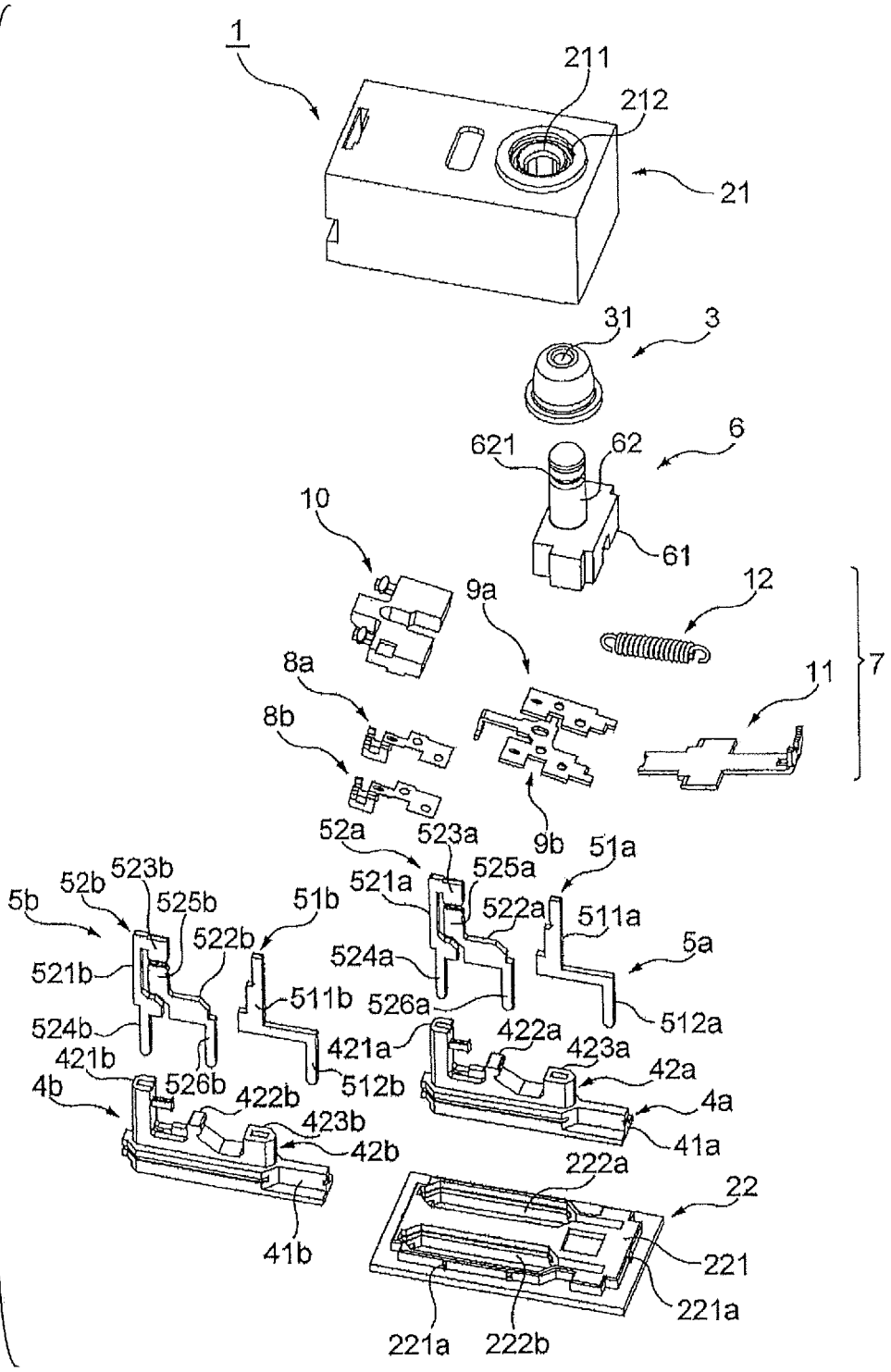
FIG. 2 is an exploded perspective view of the switching device according to the first embodiment.

FIG. 1 is a perspective view illustrating the appearance of a switching device 1 according to the first embodiment of the present disclosure. FIG. 2 is an exploded perspective view of the switching device 1 according to the first embodiment. As illustrated in FIG. 1, the switching device 1 according to the first embodiment is configured such that a portion of the operation member 6 described below protrudes from a portion of an upper surface of a box-shaped housing 2, and such that a press operation performed using a protruded portion of the operation member via an operator or the like is received. A cover 3 for preventing foreign matter such as dust and water from entering the housing 2 is attached to a portion of the operation member 6 that protrudes from the housing 2.

As illustrated in FIG. 2, the switching device 1 includes the housing 2 that is formed by molding, for example, an insulating resin material. The housing 2 includes an upper-portion case 21 having a box shape of which the lower side is open, and includes a lower-portion case 22 that has a shape corresponding to the opening of the upper-portion case 21 and that constitutes an inner bottom surface of the switching device 1. By combining the upper-portion case 21 and the lower-portion case 22, an accommodating portion that accommodates component parts of the switching device 1 is formed in an interior of the housing 2.

An opening 211 through which an upper end portion of a shaft portion 62 of the operation member 6 described below can pass is formed at an upper surface of the upper-portion case 21. Further, a groove 212, to which an outer edge of the cover 3 described above is fitted, is formed in the surroundings of the opening 211. The lower-portion case 22 has a rectangular shape in a plan view, and a protruding surface 221 having a shape corresponding to the opening of the upper-portion case 21 is provided on an upper surface of the lower-portion case. By accommodating the protruding surface 221 in the opening of the upper-portion case 21, the upper-portion case 21 is appropriately positioned. A plurality of protruding portions 221*a* that protrude laterally are provided in the surroundings of the protruding surface 221. When the upper-portion case 21 covers the lower-portion case 22, the protruding portions 221*a* are pressed into an inner wall surface of the upper-portion case 21, so that the upper-portion case 21 is attached to the lower-portion case 22. Further, two openings 222*a* and 222*b* are formed at the protruding surface 221, along a long side of the upper-portion case 21. Supports 4*a* and 4*b* described below are disposed at the respective openings 222*a* and 222*b*.

In the accommodating portion formed in the housing 2, a pair of supports 4*a* and 4*b* and the pair of fixed contacts 5*a* and 5*b* that are secured to the lower-portion case 22 are disposed, and further, the operation member 6 through which the press operation is performed by the operator or the like, as well as a snap action mechanism 7 that operates in accordance with the press operation through the operation member 6, are accommodated. As described below in detail, the snap action mechanism 7 includes a first drive member 90 (see FIGS. 5A and 5B as not illustrated in FIG. 2), in which a coupling member 10 couples a pair of first drivers 9*a* and 9*b* to which a pair of movable contacts 8*a* and 8*b* are attached, and includes a second driver 11 and an extension spring 12 of which one end is attached to the first drive member 90 and another end is attached to the second driver 11.

The support 4*a* is formed by molding an insulating resin material, for example. The support 4*a* has a base 41*a* having a shape corresponding to the opening 222*a* of the lower-portion case 22 described above, and has a protruding portion 42*a* that is provided to protrude upward from the base 41*a*. The protruding portion 42*a* has three protruding pieces 421*a* to 423*a*. The support 4*a* is configured to be integral with the opening 222*a*, at the base 41*a* and to support a portion of the fixed contact 5*a* that is insert molded, by the protruding portion 42*a*. Note that except that a support 4*b* is disposed at the opening 222*b* of the lower-portion case 22 and the fixed contact 5*b* is insert molded, the support 4*b* has the same configuration as the support 4*a*. Accordingly, in the drawings, b is appended as in a base 41*b*, and the description for such components will be omitted.

The supports 4*a* and 4*b* are formed integrally with the lower-portion case 22, by double-shot molding. In double-shot molding, when the supports 4*a* and 4*b* are formed, the fixed contacts 5*a* and 5*b* are insert molded and the supports 4*a* and 4*b* are formed. Then, the lower-portion case 22 is further molded at the bases 41*a* and 41*b* of the supports 4*a* and 4*b*. In the molding, the openings 222*a* and 222*b* are formed. However, a method of providing the supports 4*a* and 4*b* on the lower-portion case 22 is not limited to the manner described above, and can be appropriately modified. For example, the supports 4*a* and 4*b* in which the fixed contacts 5*a* and 5*b* are insert molded are respectively disposed at the respective openings 222*a* and 222*b* of the lower-portion case 22 and may be integrated by fixing the supports with an adhesive or the like.

The fixed contact 5*a* has a common contact 51*a* and a transfer contact 52*a* that are insert molded into the support 4*a*. The common contact 51*a* and the transfer contact 52*a* are separated by a fixed distance, along a longitudinal direction of the support 4*a*, and are provided in an upward position. The common contact 51*a* includes a contact portion 511*a* that extends upward from the protruding piece 423*a* and that contacts a fulcrum 92*a* of the first driver 9*a* described below, and includes a terminal portion 512*a* that is bent from the contact portion 511*a* toward a side opposite the transfer contact 52*a* and that extends downward from an end portion of the bent terminal portion.

The transfer contact 52*a* includes a first transfer contact 521*a* that protrudes slightly from the protruding piece 421*a*, and includes a second transfer contact 522*a* that is embedded proximal to the protruding piece 422*a* and that is disposed proximal to the first transfer contact 521*a*. The first transfer contact 521*a* includes a slide contact portion 523*a* that the movable contact 8*a* is in sliding contact with, and includes a terminal portion 524*a* extending downward from the slide contact portion 523*a*. The second transfer contact 522*a* includes a slide contact portion 525*a* that the movable contact 8*a* is in sliding contact with, and includes a terminal portion 526*a* that is bent from a lower end portion of the slide contact portion 525*a* toward a side opposite the common contact 51*a* and that extends downward from an end portion of a bent portion thereof. In this case, the lower end portion of the slide contact portion 523*a* of the first transfer contact 521*a*, and the upper end portion of the slide contact portion 525*a* of the second transfer contact 522*a* are disposed close together. By moving contact portions 83*a* of the movable contact 8*a* described below between the slide contact portion 523*a* and the slide contact portion 525*a*, a state of a circuit is changed over.

In the switching device 1 according to the first embodiment, the first transfer contact 521*a* serves as a normally closed contact while the second transfer contact 522*a* serves as a normally opened contact. The circuit is configured to be changed over such that when each contact portions 83*a* of the movable contact 8 described below contacts the slide contact portion 523*a*, the first transfer contact 521*a* as the normally closed contact, and the common contact 51*a* become conductive, and such that when each contact portion 83*a* of the movable contact 8 contacts the slide contact portion 525*a*, the second transfer contact 522*a* as the normally opened contact, and the common contact 51*a* become conductive. A circuit similar to the above circuit is provided with respect to a common contact 51*b* and a transfer contact 52*b* (a first transfer contact 521*b* and a second transfer contact 522*b*). Further, the movable contacts 8*a* and 8*b* are immediately operated when the snap action mechanism 7 operates as described below. Such circuits are configured to be synchronized and changed over accordingly.

The operation member 6 is formed by molding, for example, an insulating resin material. The operation member 6 includes a generally rectangular-shaped pressing portion 61 and a cylindrical shaft portion 62 that is provided in an upward position on an upper surface of the pressing portion 61. The pressing portion 61 presses one end portion of the second driver 11, in accordance with the press operation through the operation member 6. An accommodating portion 611 for accommodating one end portion of the second driver 11 is provided on a lower surface of the pressing portion 61 (not illustrated in FIG. 2. see FIG. 15). The shaft portion 62 is disposed to protrude, through the opening 211 of the upper-portion case 21, from the upper end portion of the upper-portion case 21, and the press operation is performed through the shaft portion 62. A groove 621 is formed proximal to an upper end portion of the shaft portion 62, in the outer periphery of the shaft portion 62. The inner edge of the hole 31, which is formed at the upper surface of the cover 3 described above, is disposed at the groove 621. Note that in FIG. 2, the cover 3 is disposed on the upper side of the operation member 6 for the sake of explanation, but in actuality is disposed outside of the upper-portion case 21.

Figure 3:
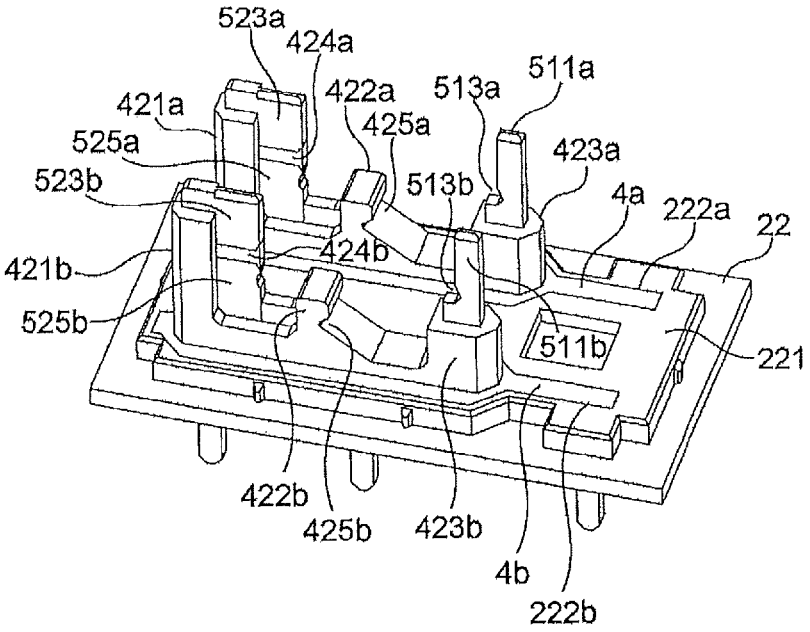
FIG. 3 is a perspective view of a lower-portion case to which supports and fixed contacts are secured in the switching device according to the first embodiment.
Figure 4A:
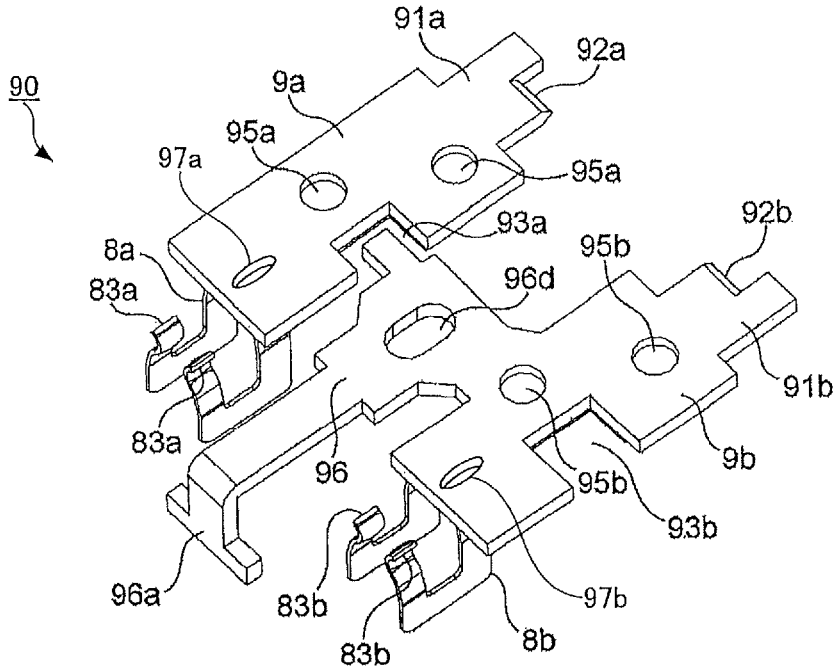
FIGS. 4A and 4B are perspective views of a first drive member included in the switching device according to the first embodiment.
Figure 4B:
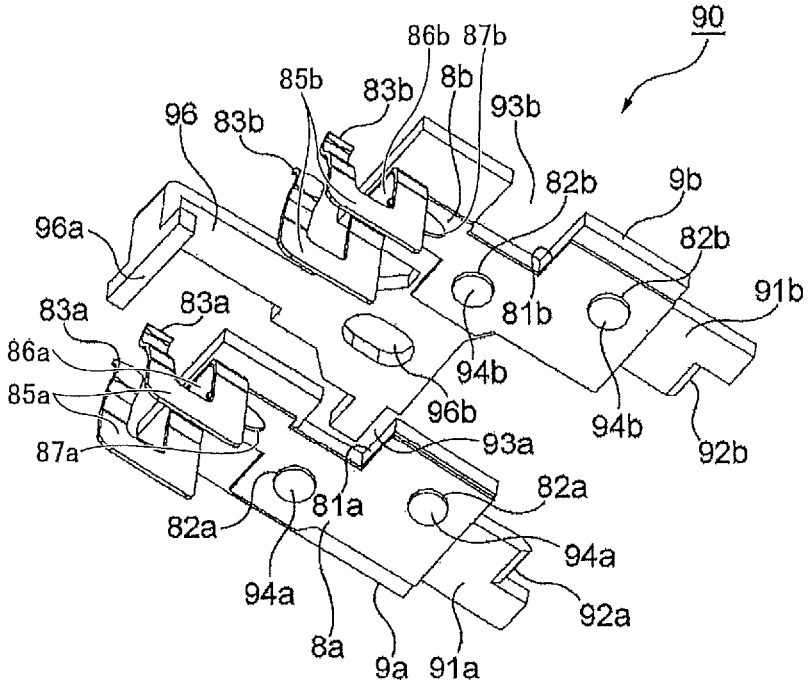
Figure 5A:
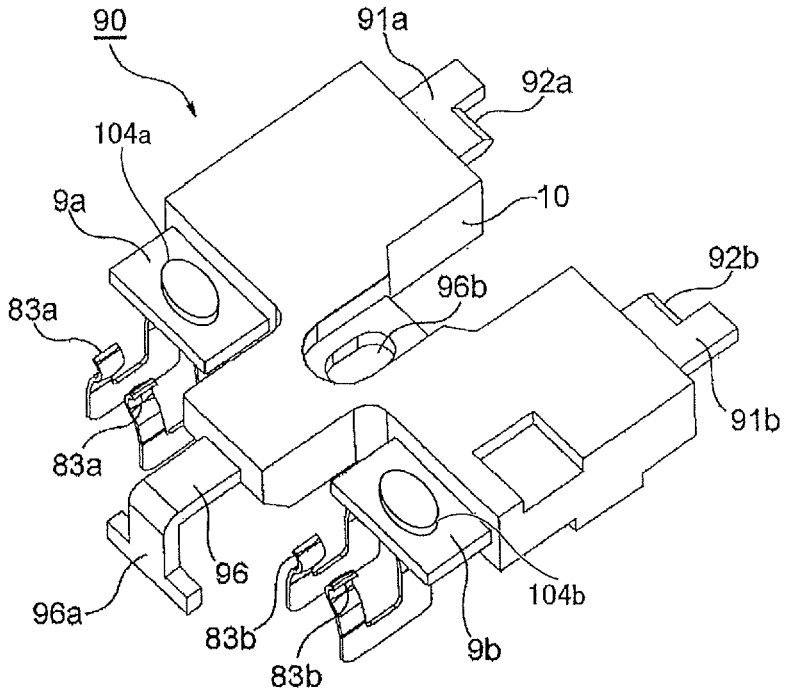
FIGS. 5A and 5B are perspective views of the first drive member included in the switching device according to the first embodiment.
Figure 5B:
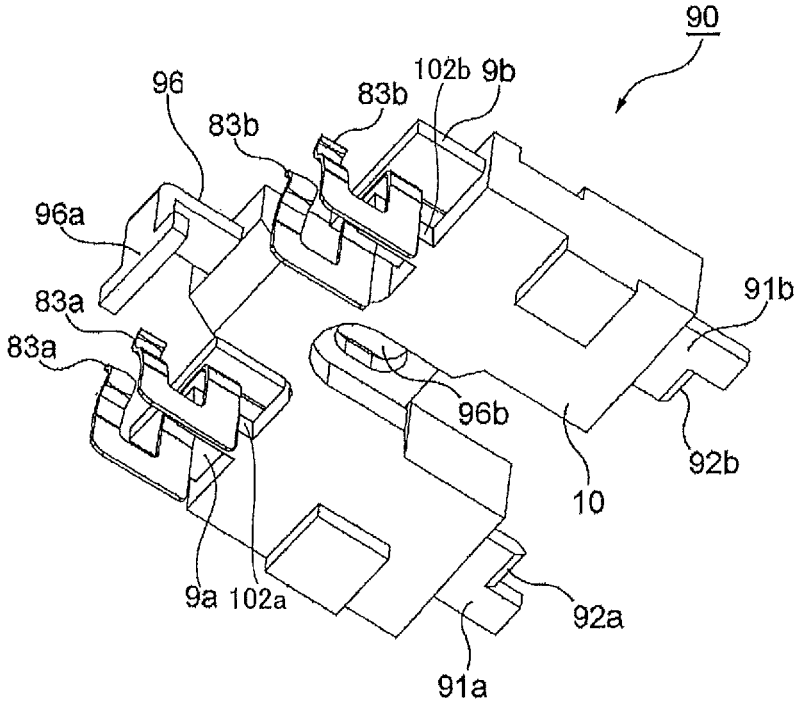
Figure 6:
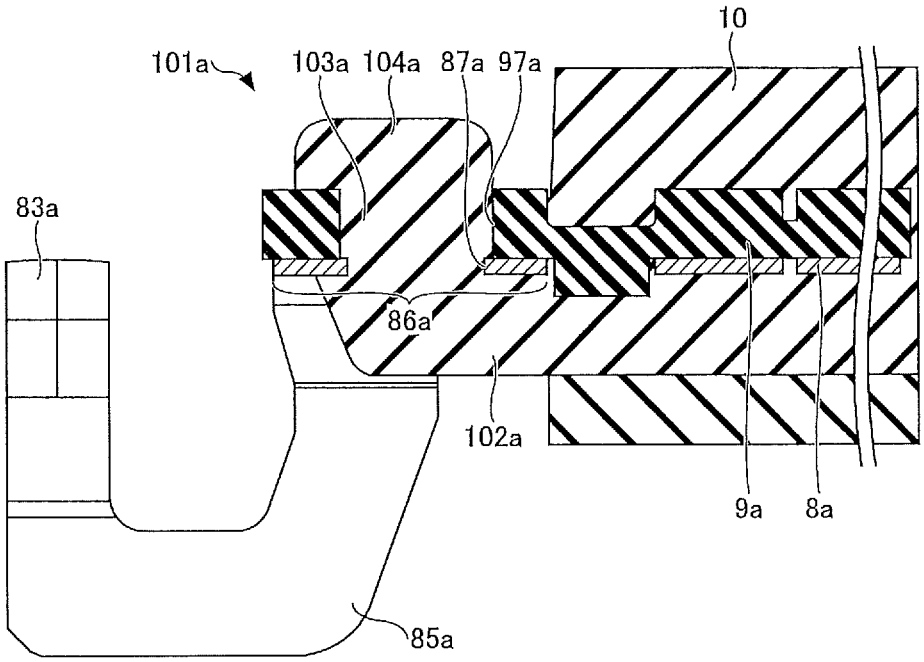
FIG. 6 is an enlarged cross-sectional side view of a portion of the switching device 1 according to the first embodiment.
Figure 7:
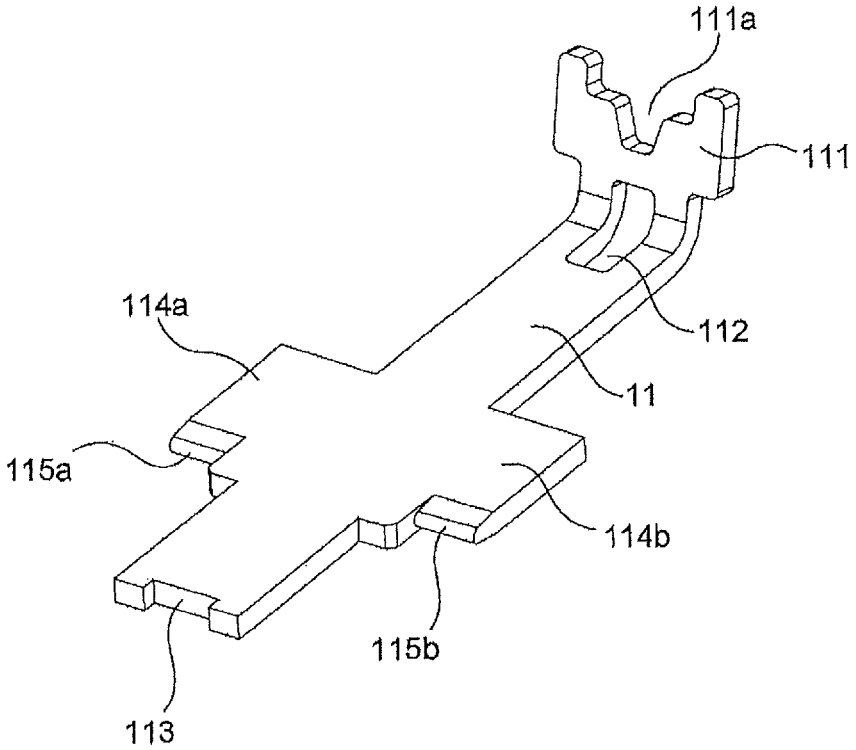
FIG. 7 is a perspective view of a second driver included in the switching device according to the first embodiment.

Hereafter, the configuration of a main portion of the switching device 1 according to the first embodiment will be described. FIG. 3 is a perspective view of the lower-portion case 22 to which supports 4 and fixed contacts 5 are secured in the switching device 1 according to the first embodiment. FIGS. 4 and 5 are perspective views of the first drive member 90 included in the switching device 1 according to the first embodiment. Note that in FIGS. 4A and 4B, the coupling member 10 is omitted from the first drive member 90. FIG. 6 is an enlarged cross-sectional side view of a portion of the switching device 1 according to the first embodiment. FIG. 7 is a perspective view of the second driver 11 included in the switching device 1 according to the first embodiment.

As illustrated in FIG. 3, the supports 4*a* and 4*b* are disposed at the respective openings 222*a* and 222*b* of the lower-portion case 22. In this case, the upper surfaces of the supports 4*a* and 4*b* are disposed at the same height as the upper surface of the protruding surface 221, and only the protruding portions 42*a* and 42*b* become in a state of protruding upward from the protruding surface 221. Note that the protruding portions 42*a* and 42*b* are juxtaposed along the short side of the lower-portion case 22, at a fixed distance therebetween.

In such a manner, the fixed contact 5*a* is embedded in the support 4*a* that is disposed on the lower-portion case 22. The common contact 51*a* is disposed such that the contact portion 511*a* protrudes from the upper end portion of the protruding piece 423*a*. In proximity to the upper end portion of the protruding piece 423*a* corresponding to the contact portion 511*a*, a recessed portion 513*a* is formed on a transfer contact 52*a* side. The recessed portion 513*a* is a portion that accommodates the fulcrum 92*a* of the first driver 9*a* described below. By accommodating the fulcrum 92*a* of the first driver 9*a* in the recessed portion 513*a*, the contact portion 511*a* rotatably supports the first driver 9.

In the transfer contact 52*a*, the first transfer contact 521*a* is disposed such that the slide contact portion 523*a* protrudes from the upper end portion and a side surface the protruding piece 421*a*. The second transfer contact 522*a* is disposed such that the slide contact portion 525*a* protrudes from the side surface of the protruding piece 421*a*. At the side surface of the protruding piece 421*a*, an insulating piece 424*a* is provided between the slide contact portion 523*a* and the slide contact portion 525*a*. The insulating piece 424*a* is a portion that temporarily interrupts a conductive state of the movable contact 8*a* that moves vertically in accordance with the press operation through the operation member 6. The insulating piece 424*a* is provided to have the same plane as each of the slide contact portion 523*a* and the slide contact portion 525*a*. Each contact portion 83*a* of the movable contact 8*a* can slide smoothly between the slide contact portion 523*a* and the slide contact portion 525*a*.

The protruding piece 422*a* is provided between the protruding piece 421*a* and the protruding piece 423*a*. A recessed portion 425*a* is provided on a side surface of the protruding piece 422*a* toward the protruding piece 423*a* (common contact 51*a* side). The recessed portion 425*a* is a portion that accommodates a fulcrum 115*a* of the second driver 11 described below. By accommodating the fulcrum 115*a* of the second driver 11 in the recessed portion 425*a*, the protruding piece 422*a* rotatably supports the second driver 11. Note that the recessed portion 425*a* is provided at a location lower than the recessed portion 513*a* provided in the common contact 51*a*.

The fixed contact 5*b* embedded in the support 4*b* is disposed in the same manner as the fixed contact 5*a* embedded in the support 4*a*. Also, similarly, a recessed portion 513*b* is provided in the contact portion 511*b* of the common contact 51*b* that protrudes from an upper end portion of a protruding piece 423*b* of the support 4*b*. Further, likewise, a recessed portion 425*b* is provided in a protruding piece 422*b* of the support 4*b*. Functions of the recessed portions 513*b* and 425*b* are substantially the same as those of the recessed portions 513*a* and 425*a*. Further, other configurations of the support 4*b* and the fixed contact 5*b* are the same as those of the support 4*a* and the fixed contact 5*a*.

As illustrated in FIGS. 4A and 4B, for the first drive member 90, each of the first drivers 9*a* and 9*b* is formed of a conductor plate having a generally rectangular shape, and the first drivers 9*a* and 9*b* are arranged side by side. Protruding pieces 91*a* and 91*b* are respectively provided on one end sides of the first drivers 9*a* and 9*b*. For an end portion of each of the protruding pieces 91*a* and 91*b*, an inner portion is shorter than an outer portion of a given protruding piece. The fulcrums 92*a* and 92*b* are provided on respective end surfaces of the above inner portions. The fulcrums 92*a* and 92*b* contact the respective recessed portions 513*a* and 513*b* that are provided in the contact portions 511*a* and 511*b* described above. The respective fulcrums 92*a* and 92*b* serve as pivot points of the first drivers 9*a* and 9*b*.

Notches 93*a* and 93*b* are formed at respective side surfaces of the first drivers 9*a* and 9*b*. The respective notches 93*a* and 93*b* are used when the movable contacts 8*a* and 8*b*, which are provided on the lower surfaces of the first drivers 9*a* and 9*b*, are positioned. Circular protruding portions 94*a* are provided lateral to the notch 93*a* and between the notch 93*a* and the protruding piece 91*a*, and further circular protruding portions 94*b* are provided lateral to the notch 93*b* and between the notch 93*a* and the protruding piece 91*b* (FIG. 4B). The circular protruding portions 94*a* and 94*b* are respectively used when the movable contacts 8*a* and 8*b* are attached to the lower surfaces of the first drivers 9*a* and 9*b*. Note that the circular protruding portions 94*a* and 94*b* are respectively formed by pressing or the like of the first drivers 9*a* and 9*b*, and recessed portions 95*a* and 95*b* are provided at respective corresponding portions of the upper surfaces of the first drivers.

Note that on a side, opposite the notch 93*b* of the first driver 9*b*, a reinforcement member 96 as a reinforcement member that extends on a side opposite the protruding piece 91*b* is provided at a location between the first driver 9*a* and the first driver 9*b*. A tip of the reinforcement member 96 extends to a location far from the contact portions 83*a* and 83*b* of the movable contacts 8*a* and 8*b* described below. An engagement piece 96*a* that is bent downward and has a T-shape is provided at the tip of the reinforcement member. The engagement piece 96*a* serves as part of engagement means, and engages with an engagement recessed portion 113 of the second driver 11 described below. A hole 96*b* is provided proximal to a base of the reinforcement member 96. The hole 96*b* is centrally situated between the first drivers 9*a* and 9*b*, and one end of the extension spring 12 is attached to the hole 96*b*.

In the switching device 1 according to the first embodiment, as described above, one end of the extension spring 12 is attached to the hole 96*b* provided in the reinforcement member 96, and thus a situation where the coupling member 10 described below is deformed by a biasing force of the extension spring 12 is less likely to occur. Accordingly, the positional accuracy of the movable contacts 8*a* and 8*b* provided on the first drivers 9*a* and 9*b* can be ensured. In particular, a portion of a conductor plate constituting part of the first driver 9*b* is used as a reinforcement portion. Thus, the coupling member 10 described below can be reinforced without preparing a special member. Note that a member different from the first driver 9*b* may be used as the reinforcement member that reinforces the coupling member 10.

Holes 97*a* and 97*b* are respectively provided on the other end portion sides (sides opposite the protruding pieces 91*a* and 91*b*) of the first drivers 9*a* and 9*b*. The holes 97*a* and 97*b* are through-holes formed at respective locations corresponding to holes 87*a* and 87*b* of the movable contacts 8*a* and 8*b* described below.

The movable contacts 8*a* and 8*b* are each formed by pressing and bending of an elastic thin plate member. In proximity to the middle of the movable contacts 8*a* and 8*b*, notches 81*a* and 81*b* are provided at one side surfaces of the movable contacts. Further, circular openings 82*a* and 82*b* are provided proximal to the respective notches 81*a* and 81*b*. By matching the notches 81*a* and 81*b* with the respective notches 93*a* and 93*b* of the first drivers 9*a* and 9*b*, and accommodating the circular protruding portions 94*a* and 94*b* of the first drivers 9*a* and 9*b* in the respective circular openings 82*a* and 82*b*, the movable contacts 8*a* and 8*b* are positioned on the respective lower surfaces of the first drivers 9*a* and 9*b*. Further, the movable contacts 8*a* and 8*b* are respectively attached to the first drivers 9*a* and 9*b* by, for example, joining together the circular protruding portions 94*a* and 94*b*. As described above, the movable contacts 8*a* and 8*b* are attached to the respective first drivers 9*a* and 9*b* by joining together, and thus the first drivers 9*a* and 9*b* can be formed of a different material from the movable contacts 8*a* and 8*b*. Accordingly, the movable contacts 8*a* and 8*b* can be formed of material suitable for movable contacts, without being limited to the material of the first drivers 9*a* and 9*b*. In this case, the movable contacts 8*a* and 8*b* are respectively provided on the end sides (the other end sides) thereof opposing the protruding pieces 91*a* and 91*b* of the first drivers 9*a* and 9*b*.

The movable contact 8*a* has a pair of U-shaped pieces 85*a*, in a side view, and the movable contact 8*b* has a pair of U-shaped pieces 85*b*, in a side view. The pair of pieces 85*a* has clip shapes of which first driver 9*a*-side upper ends are coupled by a coupling portion 86*a*, and the contact portions 83*a* are provided at respective tips of the pieces 85*a* opposing the first driver 9*a*. The pair of pieces 85*b* has clip shapes of which first driver 9*b*-side upper ends are coupled by a coupling portion 86*b*, and the contact portions 83*b* are provided at respective tips of the pieces 85*b* opposing the first driver 9*b*. In other words, the tips of the contact portions 83*a* extend upward from the movable contact 8*a*, and the contact portions 83*a* are disposed to face each other at a fixed distance therebetween. The tips of the contact portions 83*b* extend upward from the movable contact 8*b*, and the contact portions 83*b* are disposed to face each other at a fixed distance therebetween. The above transfer contact 52*a* is disposed between the contact portions 83*a*, and each of the contact portions 83*a* is configured to be able to be in sliding contact with the slide contact portions 523*a* and 525*a*. The above transfer contact 52*b* is disposed between the contact portions 83*b*, and each of the contact portions 83*b* is configured to be able to be in sliding contact with the slide contact portions 523*b* and 525*b*. Each of the movable contacts 8*a* and 8*b* is configured such that the lower side of the movable contact can be opened. For this reason, when the movable contacts 8*a* and 8*b* are incorporated into the switching device 1, each of the contact portions 83*a* and 83*b* can be prevented from being damaged by contact between a given transfer contact from among the transfer contacts 52*a* and 52*b*, and a given contact portion from among the contact portions 83*a* and 83*b* of the movable contacts 8*a* and 8*b*.

The coupling portions 86*a* and 86*b* are portions that contact the other end portions of the first drivers 9*a* and 9*b*, and the above-mentioned holes 87*a* and 87*b* are provided on the coupling portions. The holes 87*a* and 87*b* are through-holes formed at respective locations corresponding to the holes 97*a* and 97*b* of the first drivers 9*a* and 9*b*. In the example of FIGS. 4A and 4B, the respective holes 87*a* and 87*b* are slots extending in longitudinal directions of the movable contacts 8*a* and 8*b*. The shape of the holes 87*a* and 87*b* is not limited to the shape described above.

In the first drive member 90, with respect to the first drivers 9*a* and 9*b* arranged as described above, the coupling member 10 is disposed such that a portion of each of the first drivers 9*a* and 9*b* and a portion of the reinforcement member 96 are exposed. In other words, as illustrated in FIGS. 5A and 5B, the coupling member 10 is disposed in a state in which a portion of the end portion of the movable contact 8*a* toward the contact portions 83*a*, a portion of the end portion of the movable contact 8*b* toward the contact portions 83*b*, a portion of each of the protruding pieces 91*a* and 91*b*, and a portion of the tip of the reinforcement member 96, the tip including the engagement piece 96*a*, and a portion of the reinforcement member proximal to the hole 96*b*, are exposed.

The coupling member 10 includes a clamping portion 101*a* that passes through the hole 87*a* and the hole 97*a* and clamps the movable contact 8*a* and the first driver 9*a*. The coupling member 10 includes a clamping portion 101*b* that passes through the hole 87*b* and the hole 97*b* and clamps the movable contact 8*b* and the first driver 9*b*. The clamping portions 101*a* and 101*b* have first stoppers 102*a* and 102*b*, connection portions 103*a* and 103*b*, and second stoppers 104*a* and 104*b*, respectively.

As illustrated in FIG. 6, the first stopper 102*a* is a portion that extends from end portions of the coupling member 10 proximal to the respective pieces 85*a* to be on the coupling portion 86*a*, and is formed to cover the hole 87*a*. The connection portion 103*a* is a portion that connects the first stopper 102*a* and the second stopper 104*a*, and is inserted in the holes 87*a* and 97*a*. The second stopper 104*a* is a portion that protrudes from the connection portion 103*a* to be on the first driver 9*a*, and is formed to cover the hole 97*a*. The first stopper 102*a* and the second stopper 104*a* clamp the coupling portion 86*a* of the movable contact 8*a* and the first driver 9*a*, from a vertical direction, and thus the coupling portion 86*a* is firmly secured to the first driver 9*a*. Note that the clamping portion 101*b* has the same configuration as the clamping portion 101*a*; accordingly, the description for the clamping portion 101*b* will be omitted.

The coupling member 10 is formed of, for example, an insulating resin material, and the first drivers 9*a* and 9*b* and the movable contacts 8*a* and 8*b* are insert molded. In this case, as illustrated in FIG. 5B, portions of the movable contacts 8*a* and 8*b* at which the first drivers 9*a* and 9*b* are attached, e.g., portions proximal to the openings 82*a* and 82*b* in which the circular protruding portions 94*a* and 94*b* are accommodated, are embedded in the coupling member 10. Thus, the movable contacts 8*a* and 8*b* are firmly secured to the respective lower surfaces of the first drivers 9*a* and 9*b*. Accordingly, a situation where the movable contacts 8*a* and 8*b* become uncoupled or displaced can be avoided.

In particular, for the first drive member 90, the first drivers 9*a* and 9*b* are formed of a different material from the movable contacts 8*a* and 8*b* each of which is in sliding contact with a given slide contact portion from among the slide contact portions 523*a*, 523*b*, 525*a*, and 525*b* of the transfer contacts 52*a* and 52*b*. The material of the first drivers 9*a* and 9*b* has greater stiffness than the material of the movable contacts 8*a* and 8*b*. In such a configuration, the first drive member 90 can ensure the elasticity of the movable contacts 8*a* and 8*b* each of which is in sliding contact with a given slide contact portion from among the slide contact portions 523*a*, 523*b*, 525*a*, and 525*b*, while ensuring the rigidity for holding the extension spring 12.

Note that the resin constituting the coupling member 10 is preferably resin having increased damping characteristics, such as a liquid crystal polymer (LCP) resin. Such resin may be a polybutylene terephthalate (PBT) resin or a polyamide resin.

The second driver 11 is formed by, for example, machining a metallic material. The second driver 11 has a generally elongate shape, as illustrated in FIG. 7. One end side of the second driver 11 is bent upward, and a pressed portion 111, which is be pressed through the operation member 6, is formed at an upper end portion of the bent second driver. An opening 112 is provided in the lower portion of the pressed portion 111. The other end of the extension spring 12, of which one end is attached to the hole 96*b* of the reinforcement member 96 of the first driver 9*b*, is attached to the opening 112. A portion of the other end of the extension spring 12 that is attached to the opening 112 engages with a recessed portion 111*a* provided in the pressed portion 111. Note that the second driver 11 is not limited to a metallic material, and may be formed of a material having stiffness.

An engagement recessed portion 113, which engages with the engagement piece 96*a* of the reinforcement member 96 of the first driver 9*b*, is provided on the end surface of the end portion of the second driver 11 opposing the pressed portion 111. The engagement recessed portion 113 serves as part of engagement means. A T-shaped arm of the engagement piece 96*a* is disposed below the engagement recessed portion 113, and a base of the engagement piece 96*a* is accommodated in the engagement recessed portion 113. In such a manner, engagement is achieved.

In the middle of the second driver 11, protruding pieces 114*a* and 114*b*, each of which protrudes laterally from the second driver, are provided. The fulcrums 115*a* and 115*b* are provided on respective end sides (end surface on the engagement recessed portion 113 side) of the protruding pieces 114*a* and 114*b* opposing the pressed portion 111. The fulcrums 115*a* and 115*b* respectively contact the recessed portions 425*a* and 425*b*, which are provided in the protruding pieces 422*a* and 422*b* of the supports 4*a* and 4*b* described above, and serve as pivot points of the second driver 11.

Figure 8:
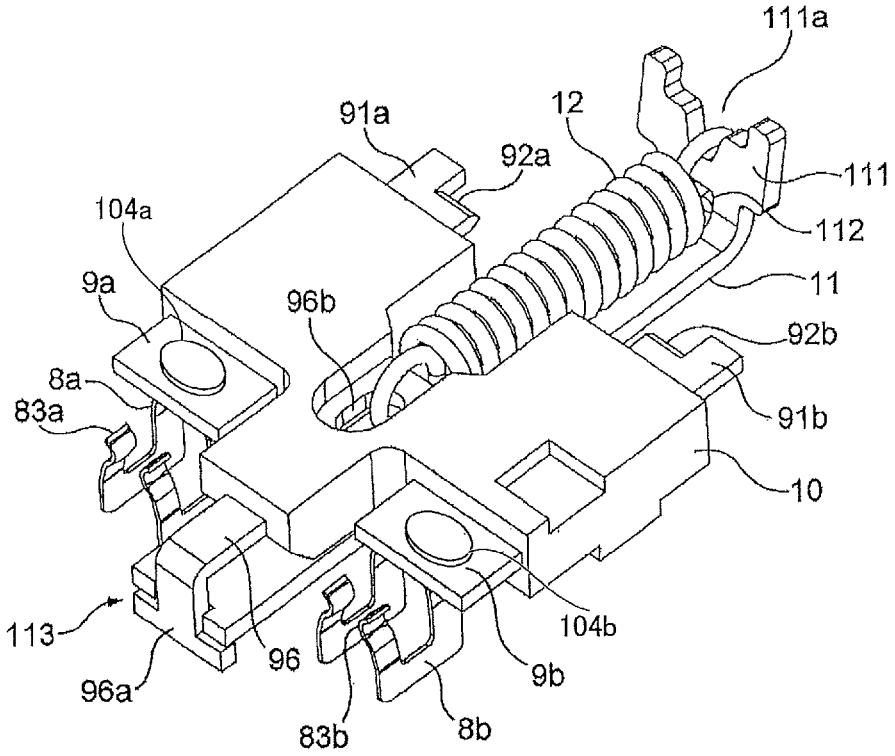
FIG. 8 is a perspective view of the first drive member and the second driver that are in an integrated state in the switching device according to the first embodiment.

The switching device 1 according to the first embodiment is configured such that the first drive member 90 and the second driver 11 are integrated and incorporated into the lower-portion case 22 in the state illustrated in FIG. 3, and the snap action mechanism 7 is thereby assembled. Hereafter, the state in which the first drive member 90 and the second driver 11 are integrated will be described. Further, the operation performed when the integrated first drive member 90 and second driver 11 are incorporated into the lower-portion case 22 in the state illustrated in FIG. 3 will be described. FIG. 8 is a perspective view of the first drive member 90 and the second driver 11 that are in an integrated state in the switching device 1 according to the first embodiment. Each of FIGS. 9A to 11B relates to a side view (figure A) of the lower-portion case 22 and a cross-sectional side view (figure B) thereof when the integrated first drive member 90 and second driver 11 are incorporated into the lower-portion case 22 that is held in the state illustrated in FIG. 3.

As illustrated in FIG. 8, one end of the extension spring 12 is attached to the hole 96*b* of the reinforcement member 96 that is exposed from the coupling member 10 in the first drive member 90. In contrast, the other end of the extension spring 12 is attached to the opening 112 of the second driver 11. The second driver 11 is disposed so as to face the reinforcement member 96 under the first drive member 90, and is in a state in which a portion of the engagement piece 96*a* of the reinforcement member 96 is accommodated in the engagement recessed portion 113. In this case, the engagement piece 96*a* restricts one end side of the second driver 11 from moving downward, the extension spring 12 restricts the other side of the second driver 11 from moving downward, and thus the second driver 11 is held in an integrated state in the first drive member 90. Further, the first drive member 90 and the second driver 11 that are in the state of being integrated are incorporated into the lower-portion case 22. In this case, the first drive member 90 and the second driver 11 can be handled in the integrated state, and thus operational efficiency can be improved when the first drive member 90 and the second driver 11 are incorporated.

Figure 9A:
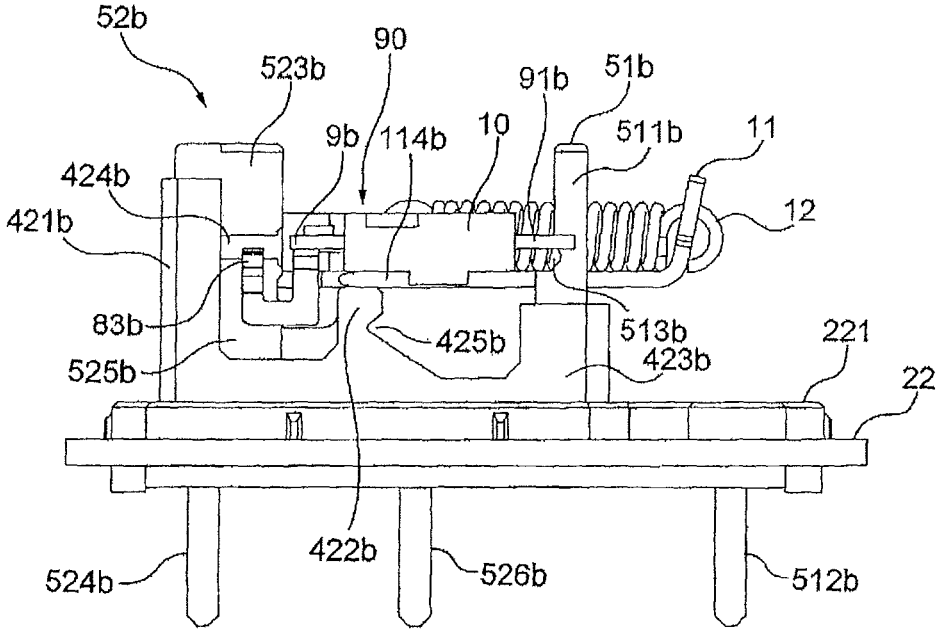
FIGS. 9A and 9B are a side view and cross-sectional side view of the lower-portion case when the integrated first drive member and second driver are incorporated into the lower-portion case that is held in the state illustrated in FIG. 3.
Figure 9B:
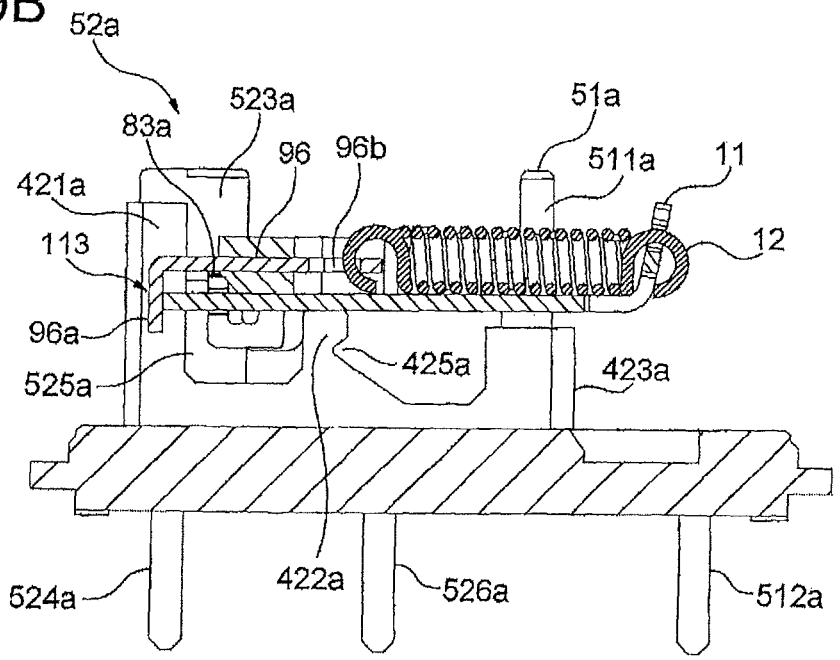

When the above integrated first drive member 90 and second driver 11 are incorporated, first, the protruding pieces 114*a* and 114*b* of the second driver 11 are disposed so as to mount on the respective upper surfaces of the protruding pieces 422*a* and 422*b* of the supports 4*a* and 42*b*, as illustrated in FIGS. 9A and 9B. In this case, the first drive member 90 and the second driver 11 are disposed such that the transfer contact 52*a* is accommodated between the contact portions 83*a* of the movable contact 8*a*, and such that the transfer contact 52*b* is accommodated between the contact portions 83*b* of the movable contact 8*b*. In this case, as described above, each of the movable contacts 8*a* and 8*b* has the configuration in which the lower side of a given contact portion is open. For this reason, the transfer contact 52*a* does not become damaged by contact between the transfer contact 52*a* and each of the contact portions 83*a* of the movable contact 8*a*. The transfer contact 52*b* does not become damaged by contact between the transfer contact 52*b* and each of the contact portions 83*b* of the movable contact 8*b*. Each of the contact portions 83*a* and 83*b* of the movable contacts 8*a* and 8*b* is in sliding contact with a given slide contact portion or the like, which is from among the slide contact portions 523*a* and 523*b* of the transfer contacts 52*a* and 52*b*. The protruding pieces 91*a* and 91*b* of the first drivers 9*a* and 9*b* are respectively disposed slightly above the recessed portions 513*a* and 513*b* of the common contacts 51*a* and 51*b*.

Figure 10A:
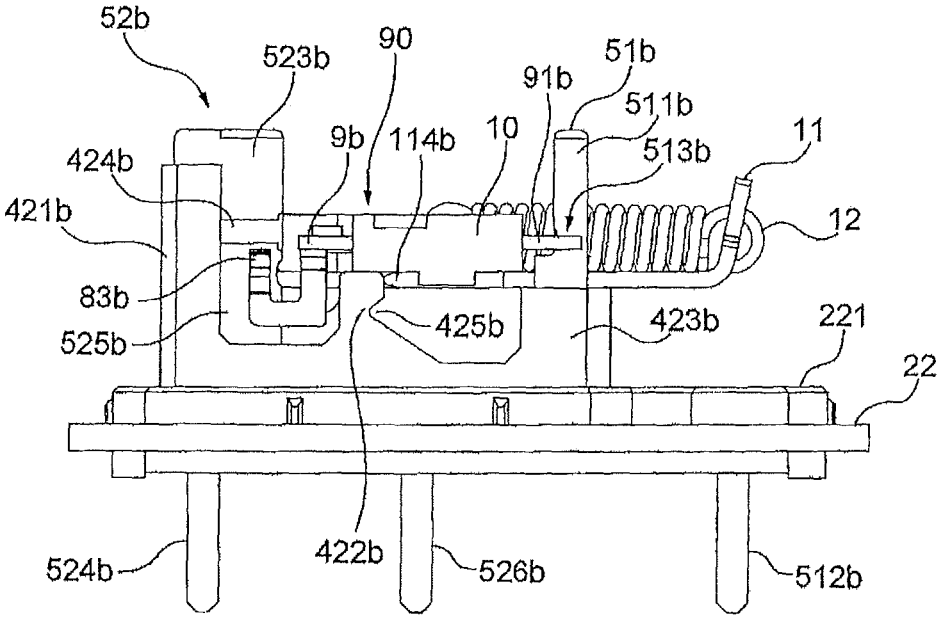
FIGS. 10A and 10B are a side view and cross-sectional side view of the lower-portion case when the integrated first drive member and second driver are incorporated into the lower-portion case that is held in the state illustrated in FIG. 3.
Figure 10B:
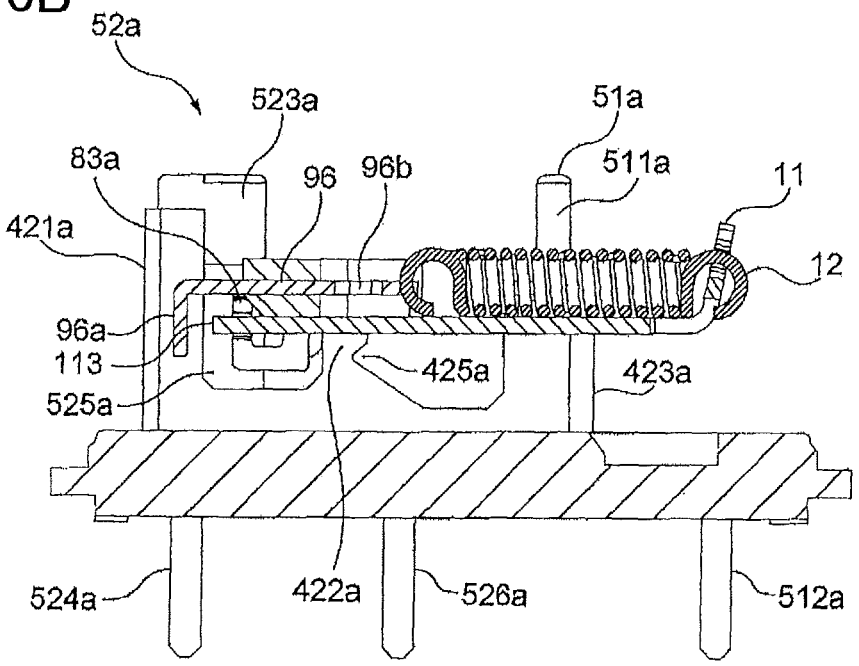

Then, as illustrated in FIGS. 10A and 10B, the fulcrums 92*a* and 92*b*, provided in the protruding pieces 91*a* and 91*b* of the first drivers 9*a* and 9*b*, are brought into contact with the respective recessed portions 513*a* and 513*b* of the common contacts 51*a* and 51*b*. Further, while acting against the biasing force of the extension spring 12, the left end portion of the second driver 11 illustrated in FIGS. 10A and 10B is pushed to the right side, to thereby interrupt the engagement between the engagement pieces 96*a* and the engagement recessed portion 113. Further, the protruding pieces 114*a* and 114*b* of the second driver 11 are respectively moved toward the recessed portions 425*a* and 425*b* of the protruding pieces 422*a* and 422*b* of the supports 4*a* and 4*b*.

Figure 11A:
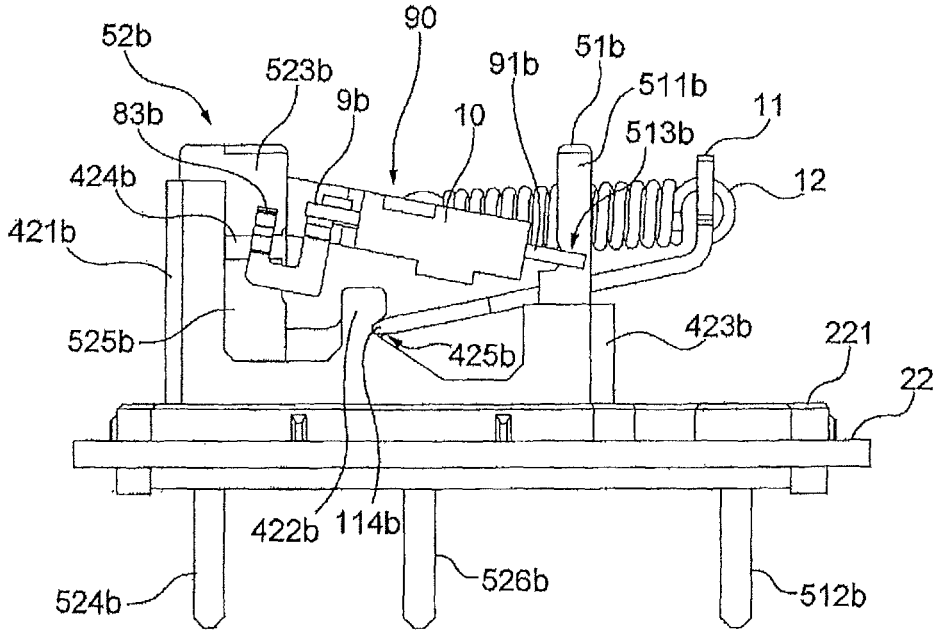
FIGS. 11A and 11B are a side view and cross-sectional side view of the lower-portion case when the integrated first drive member and second driver are incorporated into the lower-portion case that is held in the state illustrated in FIG. 3.
Figure 11B:
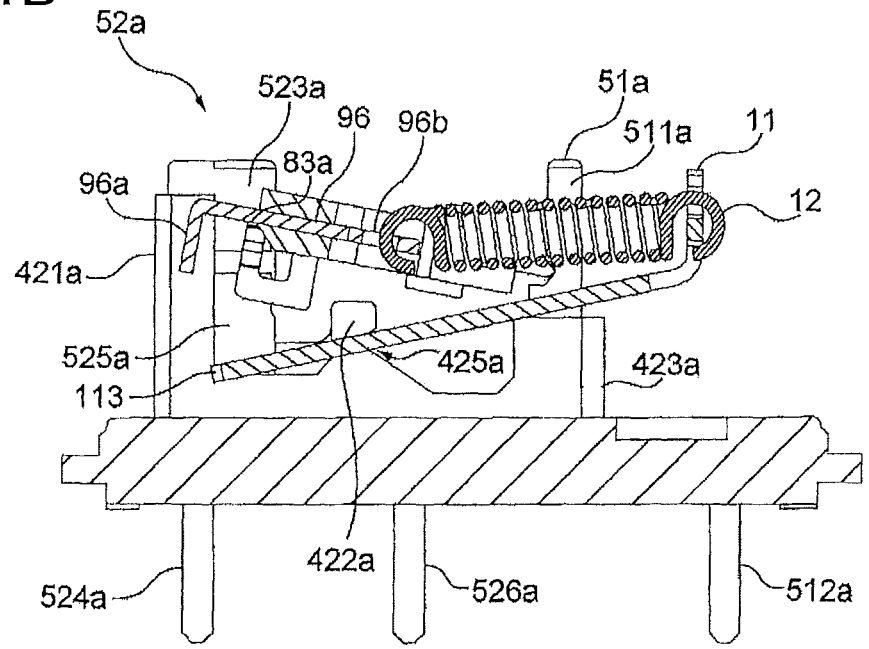

Then, as illustrated in FIGS. 11A and 11B, the fulcrums 115*a* and 115*b* of the protruding pieces 114*a* and 114*b* of the second driver 11 are brought into contact with the respective recessed portions 425*a* and 425*b* of the protruding pieces 422*a* and 422*b* of the supports 4*a* and 4*b*. In such a state in which the fulcrums 115*a* and 115*b* contact the respective recessed portions 425*a* and 425*b*, when a hand is released, the first drive member 90 and the second driver 11 to which the biasing force to attract each other is applied, by the extension spring 12, are rotatably retained at given fulcrums from among the fulcrums 92*a* and 92*b*, which contact the respective recessed portions 513*a* and 513*b*; and the fulcrums 115*a* and 115*b* that contact the respective recessed portions 425*a* and 425*b*. In the switching device 1, the snap action mechanism 7 is configured by the first drive member 90, the second driver 11, and the extension spring 12 that are in the state of being incorporated into the lower-portion case 22.

Figure 12:
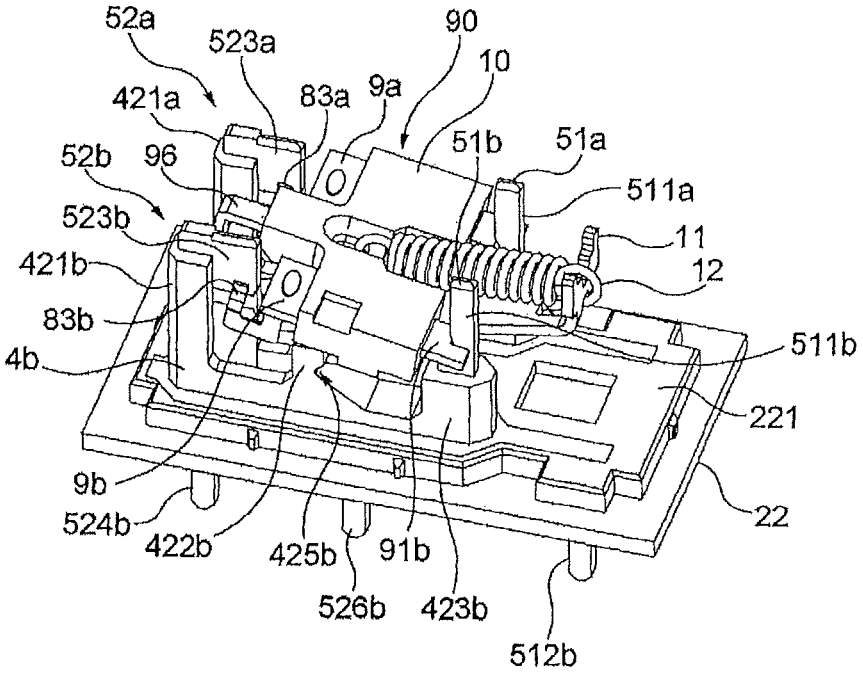
FIG. 12 is a perspective view of the lower-portion case into which a snap action mechanism is incorporated in the switching device according to the first embodiment.
Figure 13:
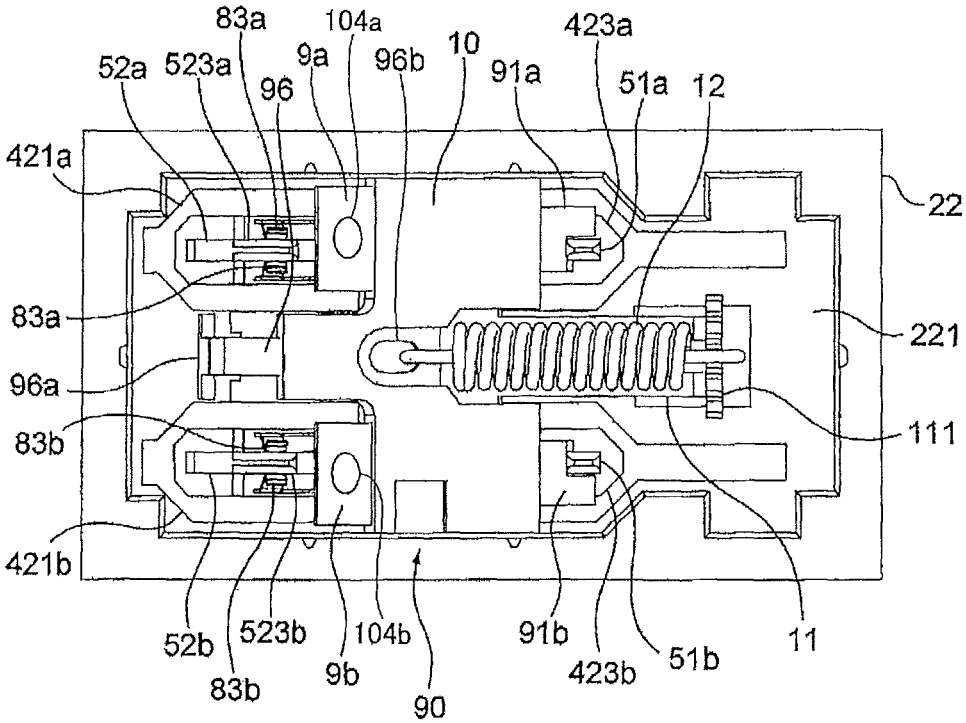
FIG. 13 is a top view of the lower-portion case into which the snap action mechanism is incorporated in the switching device according to the first embodiment.
Figure 14A:
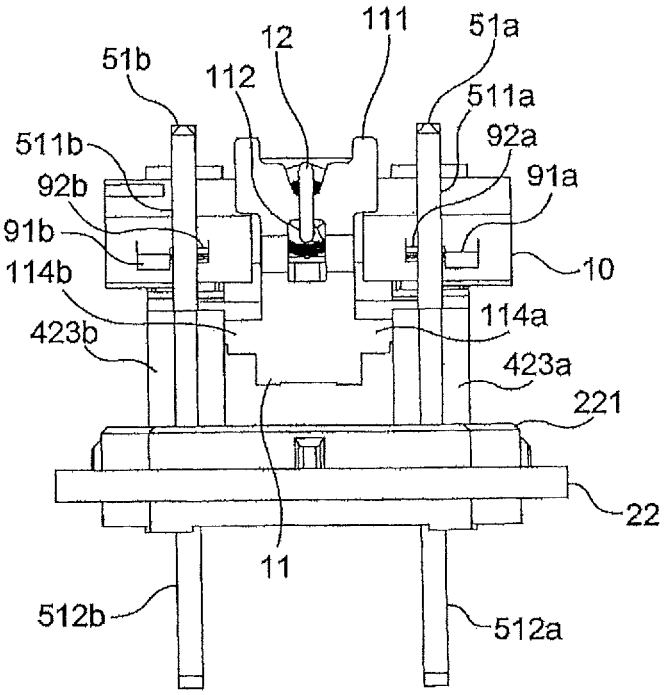
FIGS. 14A and 14B are side views of the lower-portion case into which the snap action mechanism is incorporated in the switching device according to the first embodiment.
Figure 14B:
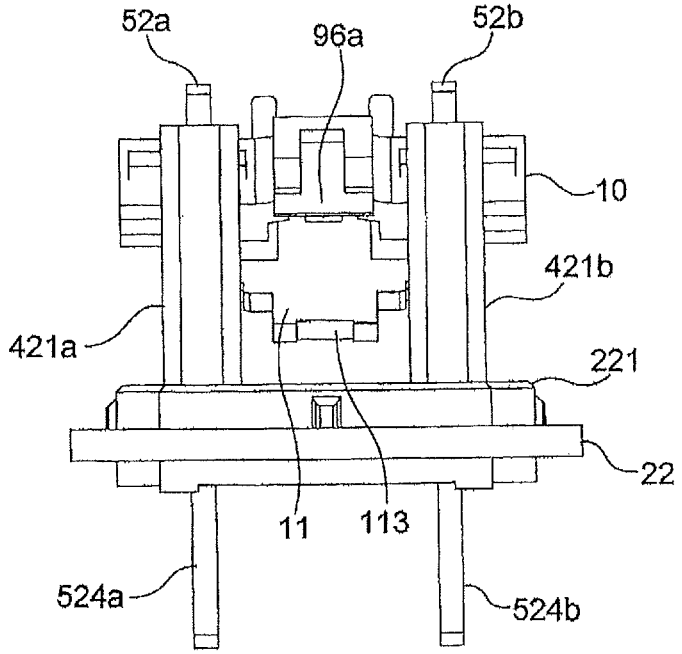

Hereafter, with reference to FIGS. 11A and 11B, the configuration of the lower-portion case 22 into which the snap action mechanism 7 is incorporated will be described using FIGS. 12 to 14B. FIGS. 12 and 13 are a perspective view and top view of the lower-portion case 22 into which the snap action mechanism 7 is incorporated, in the switching device 1 according to the first embodiment. FIGS. 14A and 14B are side views of the lower-portion case 22 into which the snap action mechanism 7 is incorporated in the switching device 1 according to the first embodiment. FIG. 14A is a side view that is from the right side illustrated in FIG. 13. FIG. 14B is a side view that is from the left side illustrated in FIG. 13.

As illustrated in FIGS. 11A, 11B, and 12, in a state of being incorporated into the lower-portion case 22, the first drive member 90 is retained in a state of being oriented upward with respect to the left side illustrated in these figures, while the second driver 11 is retained in a state of being oriented upward with respect to the right side illustrated in these figures. The movable contacts 8*a* and 8*b* that are disposed on the underside of the first drive member 90 extend on the left upper side illustrated in FIGS. 11A, 11B, and 12, and each of the contact portions 83*a* and 83*b* of the movable contacts 8*a* and 8*b* is in sliding contact with a given slide contact portion from among the slide contact portions 523*a* and 523*b* of the transfer contacts 52*a* and 52*b*. In this case, as illustrated in FIGS. 11A and 11B, the transfer contacts 52*a* and 52*b* are respectively disposed at locations further than locations at which the fulcrums 115*a* and 115*b* of the second driver 11 are disposed, relative to locations at which the fulcrums 92*a* and 92*b* of the first drive member 90 are disposed. Thus, a travel distance of each of the movable contacts 8*a* and 8*b* can be increased, so that transferring of the contacts can be easily performed.

As illustrated in FIGS. 13 and 14, the fixed contacts 5*a* and 5*b* (the common contacts 51*a* and 51*b* and the transfer contacts 52*a* and 52*b*) are arranged at a predetermined distance from the lower-portion case 22, and are arranged side by side. For the first drive member 90, the first drivers 9*a* and 9*b* are disposed at respective locations corresponding to the fixed contacts 5*a* and 5*b*, and the movable contacts 8*a* and 8*b* are disposed at locations at each of which a given transfer contact from among the transfer contacts 52*a* and 52*b* is sandwiched. The second driver 11 is disposed below the first drive member 90 so as to pass along the middle portion of the first drive member, and is connected to the hole 96*b* provided in the reinforcement member 96, through the extension spring 12.

Figure 15:
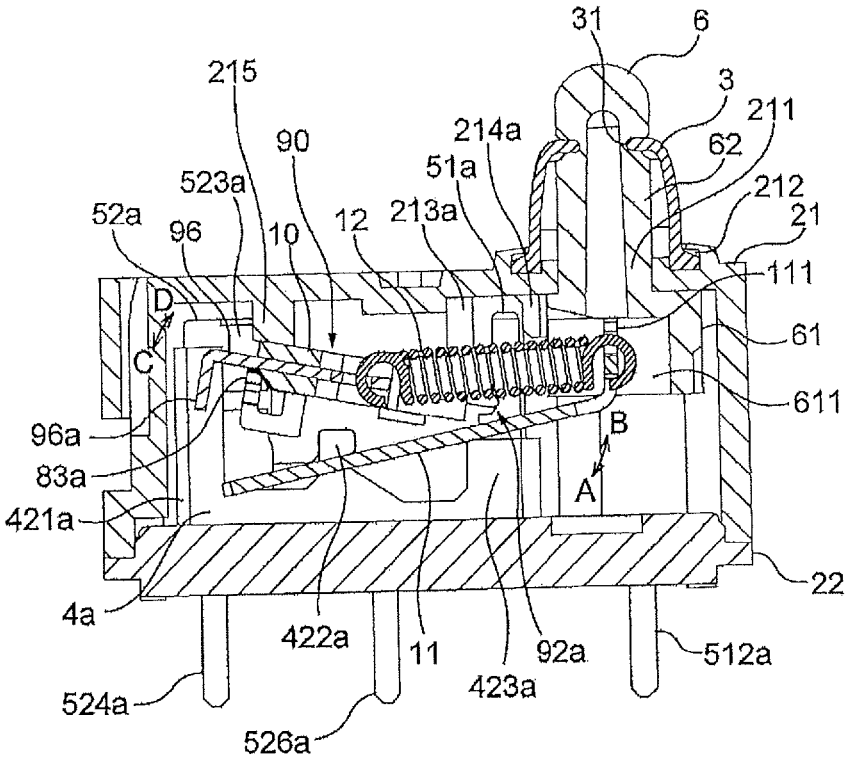
FIG. 15 is a cross-sectional side view of the switching device for explaining the internal configuration thereof according to the first embodiment.

In the switching device 1 according to the first embodiment, the upper-portion case 21 is attached to the lower-portion case 22 into which the snap action mechanism 7 is incorporated as described above, in a state in which the operation member 6 is accommodated in the accommodating portion. Hereafter, the internal configuration of the switching device 1 according to the first embodiment will be described. FIG. 15 is a cross-sectional side view of the switching device 1 for explaining the internal configuration thereof according to the first embodiment.

As illustrated in FIG. 15, the operation member 6 is disposed at the accommodating portion in the housing 2, in a state in which the pressed portion 111 of the second driver 11 is accommodated in the accommodating portion 611 that is provided at the lower surface of the pressing portion 61, and in which the shaft portion 62 is provided through the opening 211. The cover 3 attached to the groove 212 is attached to the outer periphery of the lower end portion of the shaft portion 62 protruding from the opening 211. Note that the upper end portion of the shaft portion 62 is in a state of protruding from the hole 31 of the cover 3.

Protruding walls 213*a* and 214*a* that slightly protrude downward are provided at respective predetermined locations of an inner wall surface (top surface) of the upper-portion case 21. The protruding walls 213*a* and 214*a* are provided at locations at which the upper end portion of the common contact 51*a* is accommodated, and serve to prevent the common contact 51*a* from leaning in a direction in which spring load of the extension spring 12 is applied, through the protruding wall 214*a* provided adjacent to and facing the common contact 51*a*. As described above, the tip of the common contact 51*a* is accommodated using the protruding walls 213*a* and 214*a* that are provided on the inner wall surface of the housing. Thus, a situation where the common contact 51*a*, to which spring load of the extension spring 12 is constantly applied, leans due to heat generated in a fixing operation or the like of a terminal associated with a substrate is unlikely to occur. Note that In FIG. 15, although not illustrated, protruding walls 213*b* and 214*b* are also provided at locations corresponding to the common contact 51*b*, on the inner wall surface (top surface) of the upper-portion case 21. In the first embodiment, the protruding walls 213*a* and 213*b* and the protruding walls 214*a* and 214*b* are provided. However, provision may be limited to the protruding walls 214*a* and 214*b* that are in the direction in which spring load of the extension spring 12 is applied.

Further, a protruding wall 215 is provided at a location of the inner wall surface (top surface) of the upper-portion case 21, and the location is nearer the second transfer contact 522*a* in relation to the protruding wall 213*a*. The protruding wall 215 is disposed on the upper side of the coupling member 10 of the first drive member 90, contacts the upper surface of the coupling member 10, and serves to restrict the first drive member 90 from rotating upward due to the spring load of the extension spring 12. As described above, the first drive member 90 can be restricted from rotating upward, by contact between the upper surface of the coupling member 10 and the protruding wall 215. Thus, the first drive member 90 can be rotated in a predetermined range, and it is possible to avoid a situation where the first drive member 90 is rotated to a position exceeding a predetermined position so that the movable contacts 8 or the like are damaged. Note that the protruding wall 215 is provided between the movable contacts 8*a* and 8*b*. However, two protruding wall 215 may be provided at respective locations corresponding to the movable contacts 8*a* and 8*b*.

In the switching device 1 according to the first embodiment, as described above, when the press operation is performed through the operation member 6 that is disposed on the pressed portion 111, the pressed portion 111 is pushed downward. In accordance with such an operation, while acting against the biasing force of the extension spring 12, the second driver 11 rotates in the direction represented by the arrow A, where the fulcrums 115*a* and 115*b* are used as pivotal points. In contrast, when the press operation through the operation member 6 is canceled, the second driver 11 rotates in the direction represented by the arrow B, in accordance with the biasing force of the extension spring 12, where the fulcrums 115*a* and 115*b* are used as pivotal points. In this case, in accordance with the location at which the second driver 11 is rotated, the first drive member 90 rotates in the direction represented by the arrow C or D, where the fulcrums 92*a* and 92*b* are used as pivotal points.

Figure 16:
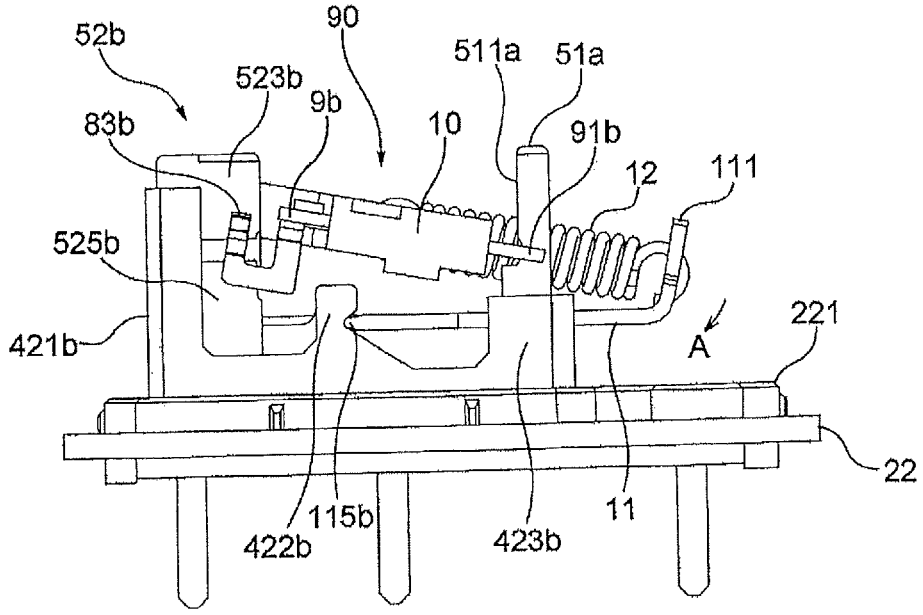
FIG. 16 is a side view of the switching device for explaining the operation associated with a press operation according to the first embodiment.
Figure 17:
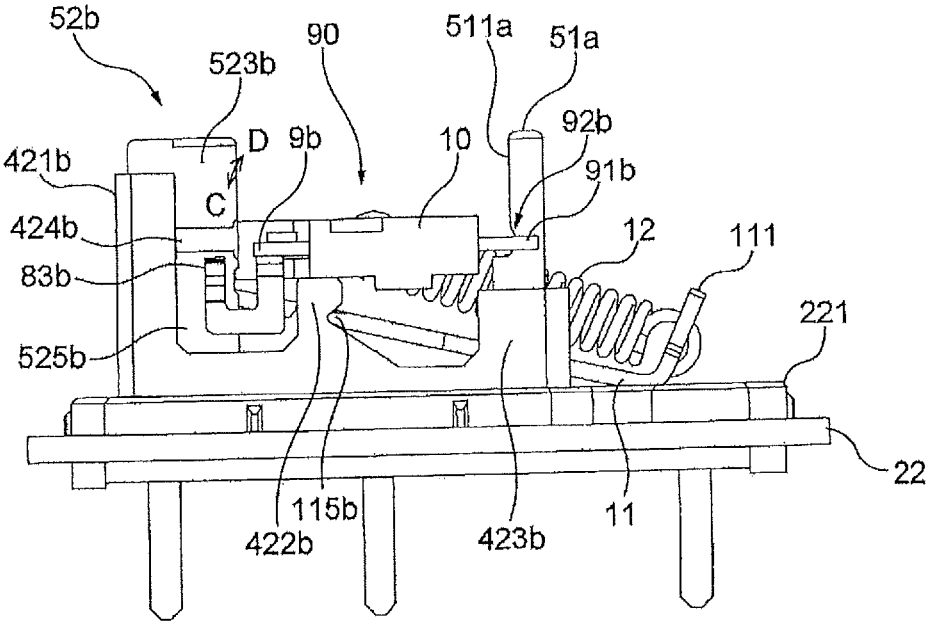
FIG. 17 is a side view of the switching device for explaining the operation associated with the press operation according to the first embodiment.
Figure 18:
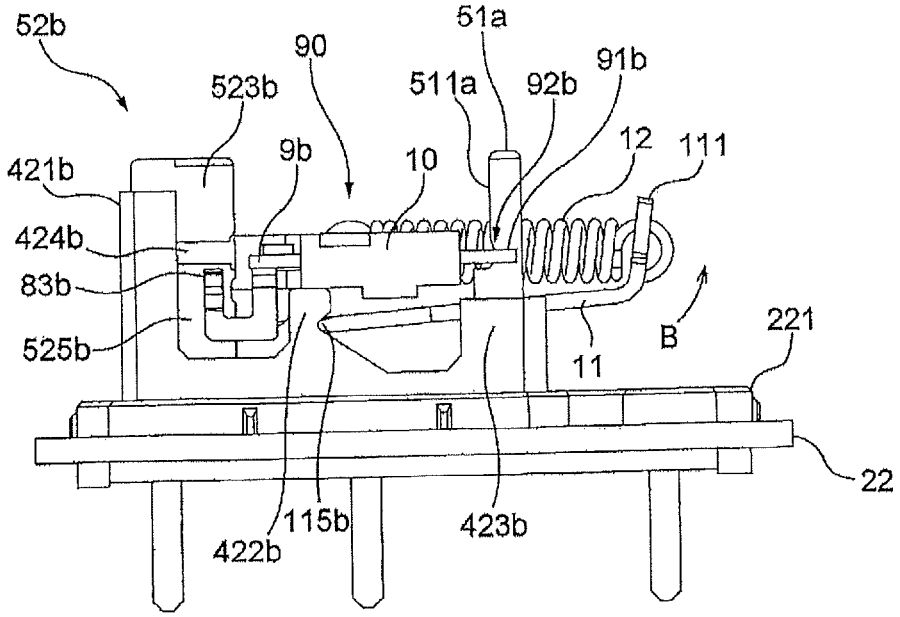
FIG. 18 is a side view of the switching device for explaining the operation associated with the press operation according to the first embodiment.

Hereafter, the operation associated with the press operation through the operation member 6 in the switching device 1 according to the first embodiment will be described. FIGS. 16 to 18 are side views of the switching device 1 for explaining the operation associated with the press operation according to the first embodiment. Note that in FIGS. 16 to 18, the upper-portion case 21, the cover 3, and the operation member 6 are omitted for the sake of explanation.

In a state (initial state) in which the press operation is yet to be performed through the operation member 6, the switching device 1 is held in the state illustrated in FIGS. 11A, 11B, and 15. The movable contacts 8*a* and 8*b* extend on the left upper side illustrated in FIGS. 11A, 11B, and 12. The slide contact portion 523*a* of the transfer contact 52*a* is sandwiched between the contact portions 83*a* of the movable contact 8*a*, and the contact portions 83*a* are in sliding contact with the slide contact portion 523*a*. The slide contact portion 523*b* of the transfer contact 52*b* is sandwiched between the contact portions 8*b* of the movable contact 8*b*, and the contact portions 83*b* are in sliding contact with the slide contact portion 523*b*. In this case, circuits each of which has a given first contact from among the first transfer contacts 521*a* and 521*b* as normally closed contacts and has a given common contact from among the common contacts 51*a* and 51*b*, are in a conductive state.

When the press operation is performed through the operation member 6 and the pressed portion 111 is pushed downward, as illustrated in FIG. 16, the second driver 11 rotates in the direction represented by the arrow A while acting against the biasing force of the extension spring 12, where the fulcrums 115*a* and 115*b* are used as pivotal points. However, until the second driver 11 is rotated to a predetermined limit position, the first drive member 90 remains in a rest state, at the initial position (position illustrated in FIGS. 11A, 11B, and 15). Thus, the contact portions 83*a* and 83*b* of the movable contacts 8*a* and 8*b* are respectively maintained in sliding contact with the slide contact portions 523*a* and 523*b*. Note that FIG. 16 illustrates a state where the second driver 11 is in a position immediately before reaching the predetermined limit position.

Then, when the second driver 11 is rotated to the predetermined limit position, the direction in which the biasing force of the extension spring 12 is applied to the first drive member 90 and the second driver 11 is reversed, and the first drive member 90 is pulled downward. Thus, as illustrated in FIG. 17, the first drive member 90 immediately rotates in the direction represented by the arrow C, where the fulcrums 92*a* and 92*b* are used as pivotal points. In this case, the contact portions 83*a* and 83*b* of the movable contacts 8*a* and 8*b* pass the insulating piece 424*b*, and are in sliding contact with the respective slide contact portions 525*a* and 525*b*. Thus, circuits each of which has a given second transfer contact from among the second transfer contacts 522*a* and 522*b* as normally opened contacts, and each of which has a given common contact from among the common contacts 51*a* and 51*b*, are changed over to a conductive state. In this case, the movable contacts 8*a* and 8*b* are provided in the respective first drivers 9*a* and 9*b* that are coupled by the coupling member 10. For this reason, the respective movable contacts 8*a* and 8*b* slide with respect to the transfer contacts 52*a* and 52*b*, at substantially the same timing, and are in sliding contact with the slide contact portions 525*a* and 525*b*.

In contrast, when the press operation through the operation member 6 is canceled, as illustrated in FIG. 18, the second driver 11 rotates in the direction represented by the arrow B, in accordance with the biasing force of the extension spring 12, where the fulcrums 115*a* and 115*b* are used as pivot points. However, until the second driver 11 is rotated to a predetermined limit position, the first drive member 90 remains in a rest state, at the position illustrated in FIG. 17. Thus, the contact portions 83*a* and 83*b* of the movable contacts 8*a* and 8*b* are maintained in sliding contact with the respective slide contact portions 525*a* and 525*b*. Note that FIG. 18 illustrates a state where the second driver 11 is in a position immediately before reaching the predetermined limit position.

When the second driver 11 is rotated to the predetermined limit position, the direction in which the biasing force of the extension spring 12 is applied to the first drive member 90 and the second driver 11 is reversed, and the first drive member 90 is pulled upward through the extension spring 12. Thus, the first drive member 90 is immediately rotated in the direction represented by the arrow D, where the fulcrums 92*a* and 92*b* are used as pivot points. Accordingly, the first drive member 90 returns to the initial position (see FIG. 15). In this case, the contact portions 83*a* and 83*b* of the movable contacts 8*a* and 8*b* pass the insulating piece 424*b*, and are in sliding contact with the respective slide contact portions 523*a* and 523*b*. In such a manner, the circuits that have the first transfer contacts 521*a* and 521*b* as normally closed contacts and have the common contacts 51*a* and 51*b*, are each changed over to a conductive state. In this case as well, the respective movable contacts 8*a* and 8*b* slide with respect to the transfer contacts 52*a* and 52*b* at substantially the same timing, and are in sliding contact with the contact portions 523*a* and 523*b*.

As described above, the switching device 1 according to the first embodiment includes the snap action mechanism 7 that drives the first drive member 90 including the movable contacts 8*a* and 8*b*. Thus, when the operation member 6 is pressed to a predetermined limit position, the movable contacts 8*a* and 8*b* provided on the integrally coupled first drivers 9*a* and 9*b* can be operated immediately in accordance with the biasing force of the extension spring 12. Accordingly, even when a plurality of circuits are synchronized and changed over, variation in a synchronization timing at which the circuits are changed over can be reduced.

In the switching device 1 according to the first embodiment, one end of the extension spring 12 is attached to the hole 96*b* provided in the reinforcement member 96 that is exposed from the coupling member 10, and a situation where the coupling member 10 is deformed due to the biasing force of the extension spring 12 is less likely to occur. Thus, the positional accuracy of the movable contacts 8*a* and 8*b* provided for the integrally coupled first drivers 9*a* and 9*b* and to switch the plurality of circuits at an appropriate timing can be ensured.

Further, in the switching device 1 according to the first embodiment, portions of the movable contacts 8*a* and 8*b* at which the first drivers 9*a* and 9*b* are attached are embedded in the coupling member 10, and the movable contacts 8*a* and 8*b* are firmly secured to the respective first drivers 9*a* and 9*b*. Thus, a situation where the movable contacts 8*a* and 8*b* become uncoupled or displaced can be avoided. Accordingly, the positional accuracy of the movable contacts 8*a* and 8*b* provided for the integrally coupled first drivers 9*a* and 9*b*, and to switch the plurality of circuits at an appropriate timing can be ensured.

Further, in the switching device 1 according to the first embodiment, the extension spring 12 is attached to the second driver 11, at a location between the first driver 9*a* and the first driver 9*b*. Thus, the movable contacts 8*a* and 8*b* provided on the first drivers 9*a* and 9*b* can be operated in accordance with the biasing force of the same extension spring 12. Accordingly, variation in a given synchronization timing at which the circuits are changed over can be further reduced.

Further, in the switching device 1 according to the first embodiment, by allowing the clamping through the clamping portions 101*a* and 101*b*, the coupling portions 86*a* and 86*b* of the movable contacts 8*a* and 8*b* are firmly secured to the respective first drivers 9*a* and 9*b*. Thus, fatigue limits of the movable contacts 8*a* and 8*b* can be increased (the number of cycles is increased until a given movable contact fails). The reasons are as follows.

When the first drive member 90 moves in accordance with the biasing force of the extension spring 12 and the circuits are changed over, shock is applied to the movable contacts 8*a* and 8*b*, at a rest position of the first drive member 90. Thus, the pieces 85*a* and 85*b* vibrate in a vertical direction, and stress is applied to the coupling portions 86*a* and 86*b* and consequently metal fatigue is accumulated in the coupling portions 86*a* and 86*b*. Vibrations of pieces 86*a* and 86*b* increase as the fixing of the coupling portions 86*a* and 86*b* with respect to the first drivers 9*a* and 9*b* decreases. Thus, stress applied to the coupling portions 86*a* and 86*b* increases and consequently metal fatigue is likely to be accumulated. Accordingly, fatigue limits of the coupling portions 86*a* and 86*b* decrease. In other words, vibrations of pieces 86*a* and 86*b* decrease as the fixing of the coupling portions 86*a* and 86*b* with respect to the first drivers 9*a* and 9*b* increases. Thus, stress applied to the coupling portions 86*a* and 86*b* decreases, so that metal fatigue is less likely to be accumulated. Accordingly, fatigue limits of the coupling portions 86*a* and 86*b* increase. In the first embodiment, the coupling portions 86*a* and 86*b* are firmly secured to the first drivers 9*a* and 9*b* through the clamping portions 101*a* and 101*b*, and thus the fatigue limits of the coupling portions 86*a* and 86*b* can increase. In particular, the clamping portion 101*a* clamps the coupling portion 86*a* and the first driver 9*a*, from the direction in which the coupling portion 86*a* vibrates. The clamping portion 101*b* clamps the coupling portion 86*b* and the first driver 9*b*, from the direction in which the coupling portion 86*b* vibrates. Accordingly, the clamping portions 101*a* and 101*b* can effectively suppress the vibrations of the pieces 85*a* and 85*b*.

Further, in the switching device 1 according to the first embodiment, the holes 87*a* and 87*b* are slots extending in the longitudinal directions of the movable contacts 8*a* and 8*b*, respectively. Thus, a distance between the hole 87*a* and each of the side end portions of the coupling portion 86*a*, as well as a distance between the hole 87*b* and each of the side end portions of the coupling portion 86*b*, are increased. In other words, a plate width of each of the coupling portions 86*a* and 86*b* can be increased. In such a manner, the coupling portions 86*a* and 86*b* are less likely to fail and thus the fatigue limits of the coupling portions 86*a* and 86*b* can be increased even more.

Further, in the switching device 1 according to the first embodiment, by making the coupling member 10 of an LCP resin, vibrations of the pieces 85*a* and 85*b* are effectively suppressed by the clamping portions 101*a* and 101*b*. Accordingly, fatigue limits of the coupling portions 86*a* and 86*b* can be increased yet even further.

Figure 19B:
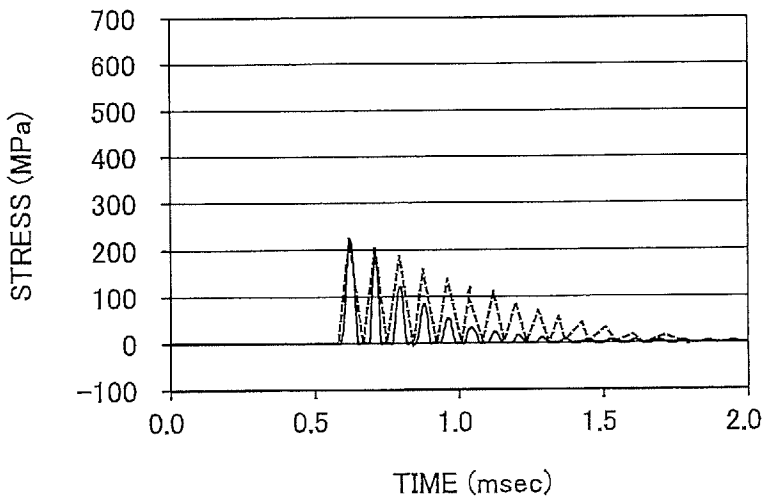
FIGS. 19A and 19B are diagrams illustrating test results for stress that is applied to coupling portions in the switching device according to the first embodiment.
Figure 19A:
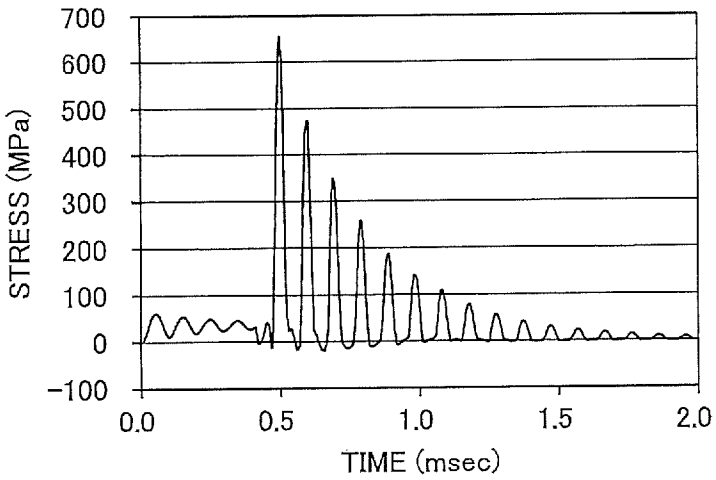

FIGS. 19A and 19B are diagrams illustrating test results for stress that is applied to coupling portions 86*a* and 86*b* in the switching device 1 according to the first embodiment. FIG. 19A illustrates test results in a case where the coupling portions 86*a* and 86*b* are secured with a swage, instead of the clamping portions 101*a* and 101*b*. FIG. 19B illustrates the test results according to the first embodiment. The dashed line in FIG. 19B indicates a case where the coupling member 10 is formed of a PBT resin. The solid line in FIG. 19B indicates a case where the coupling member 10 is formed of an LCP resin.

As illustrated in FIGS. 19A and 19B, when the coupling portions 86*a* and 86*b* were secured using the clamping portions 101*a* and 101*b*, stress applied to the coupling portions 86*a* and 86*b* was reduced compared to the case where the coupling portions 86*a* and 86*b* were secured with a swage. Further, as illustrated in FIG. 19B, when the coupling member 10 was formed of the LCP resin, stress applied to the coupling portions 86*a* and 86*b* was reduced compared to the case where the coupling member 10 was formed of the PBT resin. As described above, according to the first embodiment, stress applied to the coupling portions 86*a* and 86*b* can be reduced, and thus fatigue limits of the coupling portions 86*a* and 86*b* can be increased. According to SN diagrams based on the test results illustrated in FIGS. 19A and 19B, when the coupling portions 86*a* and 86*b* are secured to the clamping portions 101*a* and 101*b*, the fatigue limit of each of the coupling portions 86*a* and 86*b* is estimated to be ten times or more greater than that in the case where the coupling portions 86*a* and 86*b* were secured with the swage.

Second Embodiment

Figure 20:
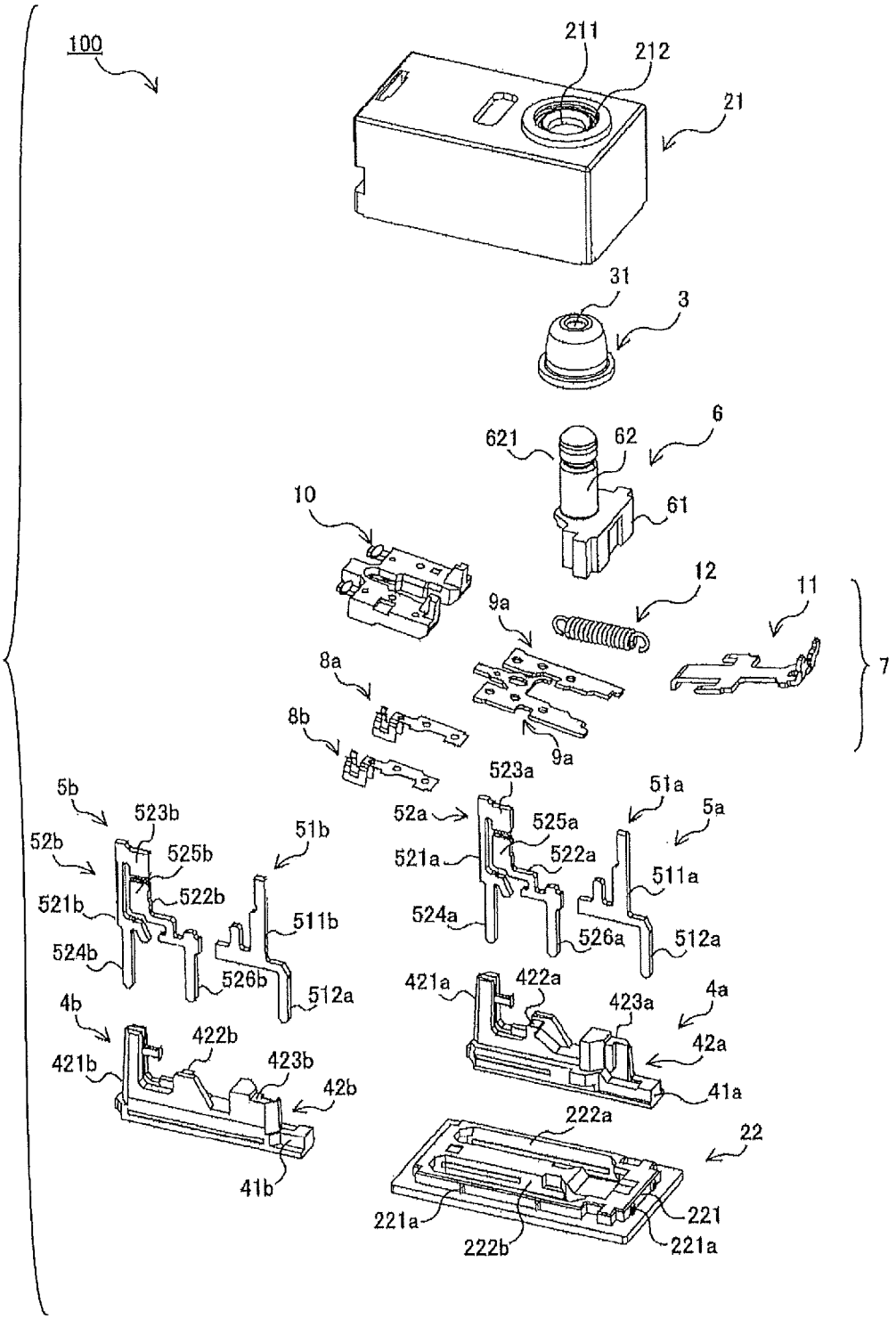
FIG. 20 is an exploded perspective view of a switching device according to a second embodiment according to the present disclosure.

FIG. 20 is an exploded perspective view of a switching device 100 according to a second embodiment. Note that for the switching device 100 illustrated in FIG. 20, the same numerals denote the configurations in common with the switching device 1 according to the first embodiment, and the description for the common configurations will be omitted. As illustrated in FIG. 20, the switching device 100 according to the second embodiment includes the housing 2, the cover 3, the supports 4, the fixed contacts 5, the operation member 6, and the snap action mechanism 7, as in the case with the switching device 1 according to the first embodiment.

For the configuration of the assembled switching device 100 according to the second embodiment, as in the case with the switching device 1 according to the first embodiment, the switching device 100 is configured such that a portion of the operation member 6 described below protrudes from a portion of the upper surface of the box-shaped housing 2, and such that the press operation is performed through the protruded portion of the operation member via the operator or the like. The cover 3 for preventing foreign matter such as dust and water from entering the housing 2 is attached to a portion of the operation member 6 that protrudes from the housing 2 (see FIG. 1).

As a whole, the switching device 100 according to the second embodiment differs from the switching device 1 according to the first embodiment, in the configuration of the supports 4*a* and 4*b*, the fixed contacts 5 (second transfer contacts 522*a* and 522*b*), and the first drive member 90. In the following, for the configuration of main components of the switching device 100 according to the second embodiment, portions that differ from the switching device 1 according to the first embodiment will be described mainly.

Figure 21:
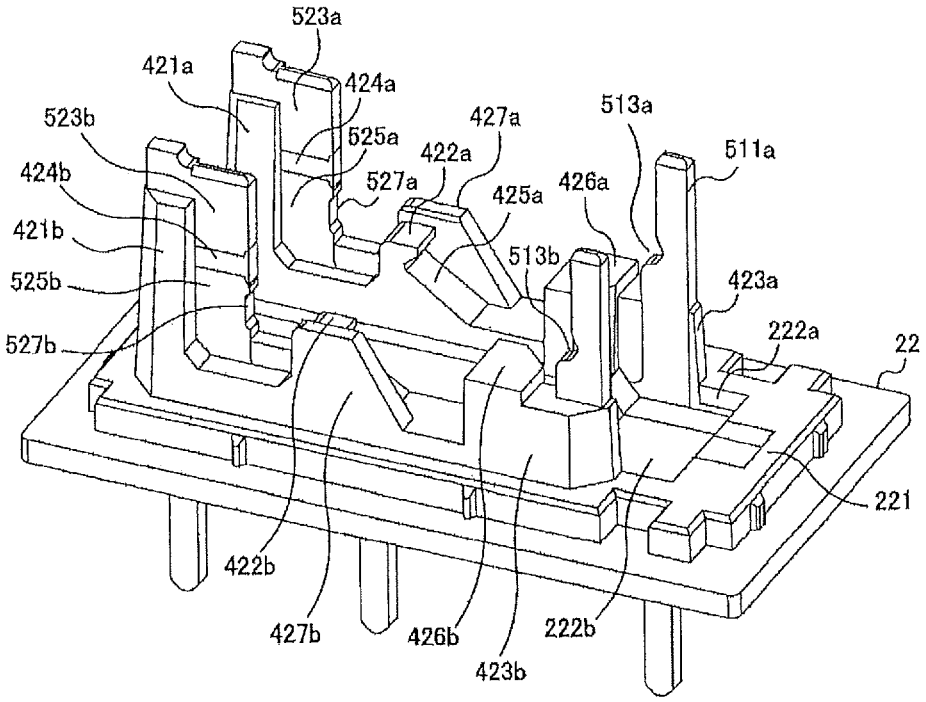
FIG. 21 is a perspective view of the lower-portion case to which supports and fixed contacts are secured in the switching device according to the second embodiment.

FIG. 21 is a perspective view of the lower-portion case 22 to which the supports 4 and the fixed contacts 5 are secured, in the switching device 100 according to the second embodiment. FIGS. 22A to 23B are perspective views of the first drive member 90 included in the switching device 100 according to the second embodiment. Note that in FIGS. 22A and 22B, the coupling member 10 is omitted from the first drive member 90. FIG. 24 is a perspective view of the second driver 11 included in the switching device 100 according to the second embodiment. Note that in FIGS. 21 to 24, the configurations in common with the configurations illustrated in FIGS. 3 to 7 are denoted by the same numerals, and the description for the common configurations will be omitted.

As illustrated in FIG. 21, the supports 4*a* and 4*b* according to the second embodiment differ from the supports 4*a* and 4*b* according to the first embodiment, in that supporting portions 426*a* and 426*b*, each of which supports a given first mounting portion of the second driver 11 described below, are provided for the respective protruding pieces 423*a* and 423*b*. The supports 4*a* and 4*b* according to the second embodiment also differ from the supports 4*a* and 4*b* according to the first embodiment, in that upper surfaces of the protruding pieces 422*a* and 422*b* serve as supporting portions each of which supports a given second mounting portion of the second driver 11 described below. Further, the supports 4*a* and 4*b* according to the second embodiment differ from the supports 4*a* and 4*b* according to the first embodiment, in that support walls 427*a* and 427*b*, each of which supports the lower surface of the coupling member 10 of the first drive member 90 when the snap action mechanism 7 is assembled, are respectively provided outside (laterally) of the protruding pieces 422*a* and 422*b*.

The support walls 427*a* and 427*b* serve to guide respective guiding portions 10*c* and 10*d* of the coupling member 10 described below, when the snap action mechanism 7 is assembled. Further, the support walls 427*a* and 427*b* serve to restrict the first drive member 90 from rotating downward due to spring load of the extension spring 12. As described above, the first drive member 90 can be restricted from rotating downward, by contact the lower surface of the coupling member 10 and each of the support walls 427*a* and 427*b*. Thus, the first drive member 90 can be rotated in a predetermined range, and a situation where the first drive member 90 is rotated to a position exceeding a constant position causing the movable contacts 8 or the like to become damaged can be avoided. Note that in the embodiment, it is preferable that a buffer material is applied to the upper surface of each of the supporting portions 426*a* and 426*b*.

Further, the fixed contacts 5 (second transfer contacts 522*a* and 522*b*) according to the second embodiment differ from the slide contact portions 525*a* and 525*b* according to the first embodiment, in that when the snap action mechanism 7 is assembled, recessed portions 527*a* and 527*b* as receiving portions, each of which accommodates the tip of a given fulcrum from among the fulcrums 115*a* and 115*b* of the second driver 11, are provided at respective side surfaces of the slide contact portions 525*a* and 525*b*, which are respectively exposed from the protruding pieces 421*a* and 421*b*, toward sides of the protruding pieces 422*a* and 422*b*.

Figure 22A:
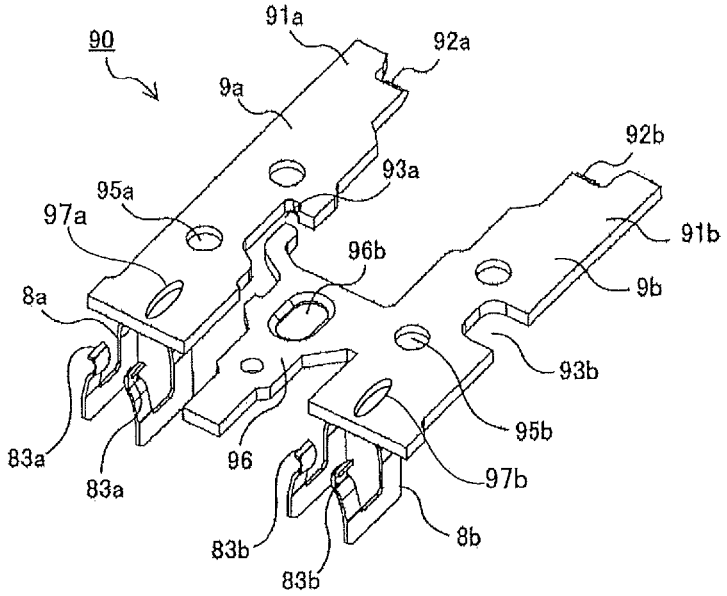
FIGS. 22A and 22B are perspective views of the first drive member included in the switching device according to the second embodiment.
Figure 22B:
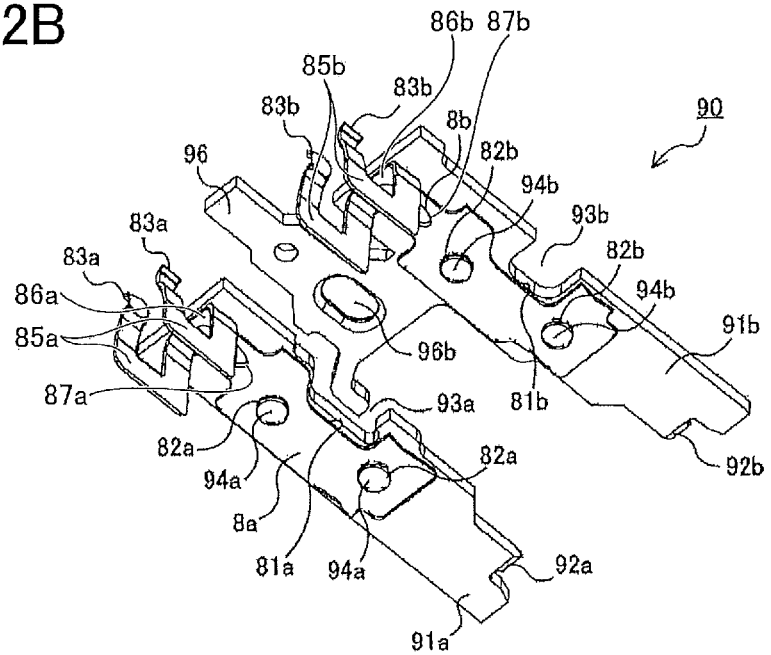

As illustrated in FIGS. 22A and 22B, the first drive member 90 according to the second embodiment differs from the first drive member 90 according to the first embodiment, in that the engagement piece 96*a* is not provided in the reinforcement member 96, and the end portion of the reinforcement member 96 extends to a location that is approximately the same as locations of the contact portions 83*a* and 83*b* of the movable contacts 8*a* and 8*b*. Note that for the first drivers 9*a* and 9*b* according to the second embodiment, there are portions that differ from the first drivers 9*a* and 9*b* according to the first embodiment in the shapes of the notches 93*a* and 93*b*, and the like. However, such differences are unsubstantial.

Figure 23A:
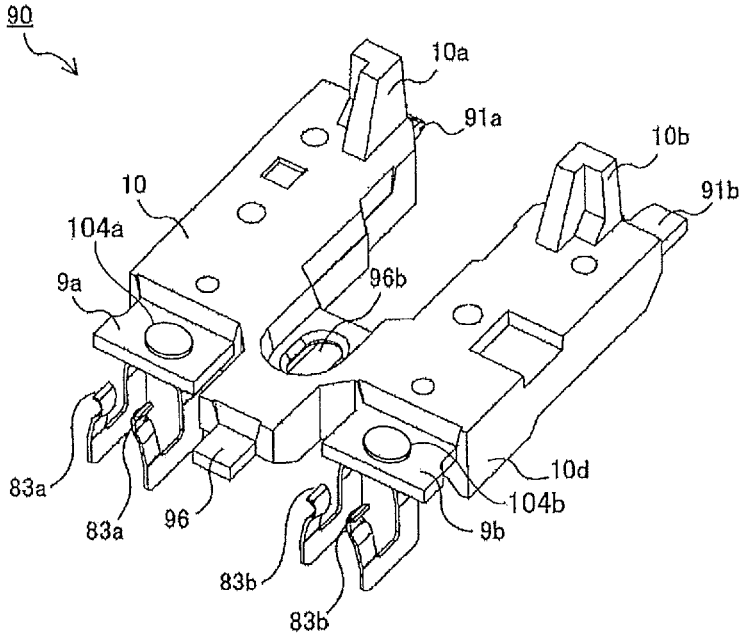
FIGS. 23A and 23B are perspective views of the first drive member included in the switching device according to the second embodiment.
Figure 24:
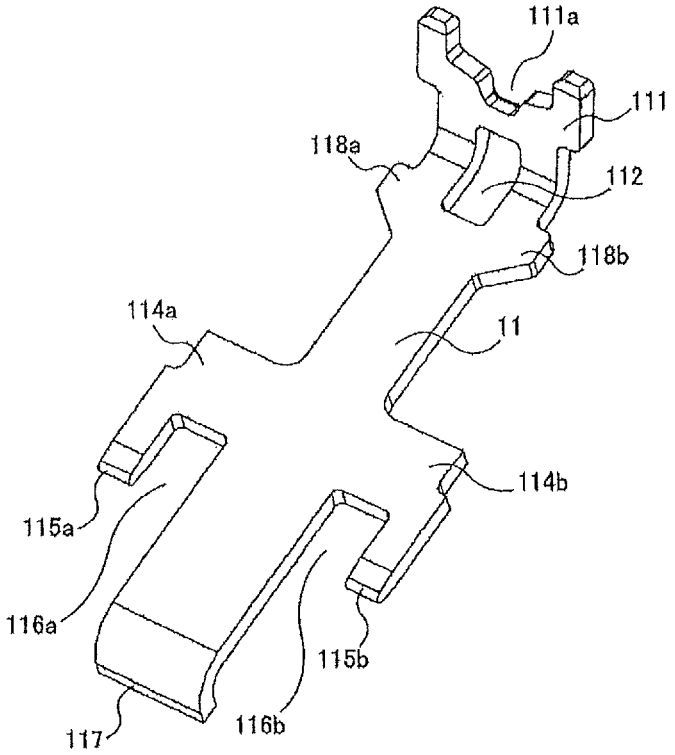
FIG. 24 is a perspective view of the second driver included in the switching device according to the second embodiment.

Further, as illustrated in FIG. 23A, the first drive member 90 according to the second embodiment differs from the first drive member 90 according to the first embodiment, in that contact pieces 10*a* and 10*b* as rotation restrictions are respectively provided on upper end surfaces of the coupling member 10 toward the protruding pieces 91*a* and 91*b*. When the snap action mechanism 7 is assembled, the contact pieces 10*a* and 10*b* serve to respectively contact the contact portions 511*a* and 511*b* of the common contacts 51*a* and 51*b*, to thereby restrict the first drive member 90 from rotating due to spring load of the extension spring 12. As described above, in the switching device 100 according to the second embodiment, the first drive member 90 can be restricted from rotating, by contact between the contact piece 10*a* of the first drive member 90 and the common contact 51*a*, as well as between the contact piece 10*b* of the first drive member 90 and the common contact 51*b*. Accordingly, in a process of the assembly operation, the first drive member 90 and the second driver 11 can be retained in a stable state, thereby enabling the operational efficiency to be improved in the assembly operation.

Figure 23B:
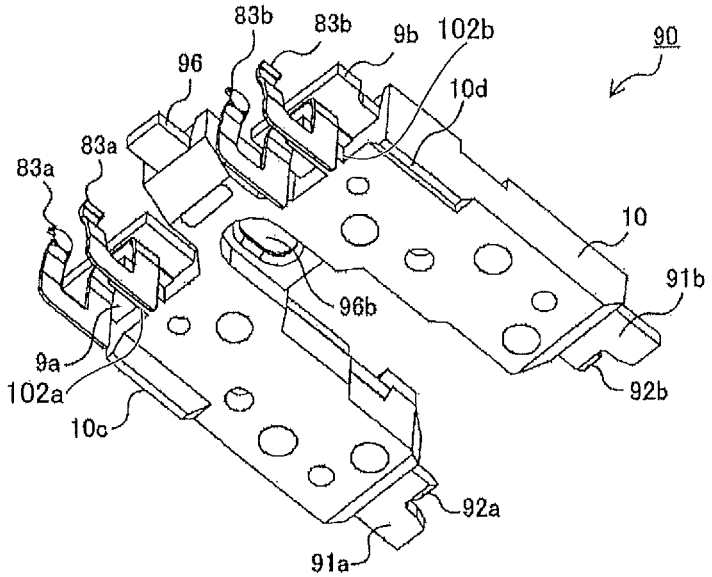

Further, as illustrated in FIG. 23B, the first drive member 90 according to the second embodiment differs from the first drive member 90 according to the first embodiment, in that the guiding portions 10*c* and 10*d* are respectively provided on lower end surfaces of the coupling member 10 toward the contact portions 8*a* and 8*b* of the movable contacts 8*a* and 8*b*. When the snap action mechanism 7 is assembled, the guiding portions 10*c* and 10*d* are in sliding contact with the respective support walls 427*a* and 427*b*, and serve to guide the first drive member 90.

Further, as illustrated in FIG. 24, the second driver 11 according to the second embodiment differs from the first drive member 90 according to the first embodiment, in that each of the protruding pieces 114*a* and 114*b* of the second driver 11 has the shape that is bent at the side end portion of the protruding piece, and fulcrums 115*a* and 115*b* are respectively provided at tips of bent portions of the protruding pieces. The fulcrum 115*a* and a main body of the second driver 11 define a space 116*a* having a fixed amount, and the fulcrum 115*b* and the main body of the second driver 11 define a space 116*b* having a fixed amount. When the snap action mechanism 7 is assembled, the space 116*a* serves to accommodate the contact portions 83*a* inside of the movable contact 8*a*, and the space 116*b* serves to accommodate the contact portions 83*b* inside of the movable contact 8*b*.

Note that in the second driver 11 according to the second embodiment, a portion of each of the protruding pieces 114*a* and 114*b* serves as a second mounting portion of the second driver 11, when the snap action mechanism 7 is assembled. As described above, in the switching device 100 according to the second embodiment, the fulcrums 115*a* and 115*b* are respectively formed in portions of second mounting portions for enabling the second driver 11 to be mounted. Thus, the respective second mounting portions can have functions provided by the fulcrums 115*a* and 115*b*. Accordingly, the configuration of the second driver 11 can be simplified.

Further, the second driver 11 according to the second embodiment differs from the first drive member 90 according to the first embodiment, in that the engagement recessed portion 113 is not provided in the second driver 11, and a contact piece 117 protruding downward is provided instead of the engagement recessed portion 113. When the snap action mechanism 7 is assembled, the contact piece 117 serves as a rotation restriction that contacts the lower-portion case 22 of the housing 2 to thereby restrict the rotation caused by spring load of the extension spring 12. As described above, in the switching device 100 according to the second embodiment, the second driver 11 can be restricted from rotating by contact between the contact piece 117 of the second driver 11 and the lower-portion case 22. Accordingly, in the process of the assembly operation, the first drive member 90 and the second driver 11 can be retained in a stable state, thereby enabling the operational efficiency to be improved in the assembly operation.

Further, in the second driver 11 according to the second embodiment, each of protruding pieces 118*a* and 118*b* that protrudes laterally is provided proximal to the opening 112 of the second driver 11. The protruding pieces 118*a* and 118*b* have the shapes each protruding slightly laterally from the pressed portion 111, and serve as first mounting portions of the second driver 11. As described above, in the switching device 100 according to the second embodiment, mounting portions include the first mounting portions on sides of the common contacts 51*a* and 51*b*, as well as the second mounting portions on sides of the common contacts 51*a* and 51*b*. Thus, the second driver 11 can be stably mounted on the upper surfaces of the supporting portions 426*a* and 426*b* and the protruding pieces 422*a* and 422*b*, each of which is in a given support from among the supports 4*a* and 4*b*. In particular, the protruding pieces 114*a* and 114*b* that constitute second mounting portions are each formed to be longer than the first mounting portion, in the direction from a given common contact from among the common contacts 51*a* and 51*b*, toward a given transfer contact from among the transfer contacts 52*a* and 52*b*. Thus, the second driver 11 stably slides and moves while maintaining a state in which the second driver 11 is supported on the upper surfaces of the supporting portions 426*a* and 426*b* and the protruding pieces 422*a* and 422*b* of the supports 4*a* and 4*b*.

The switching device 100 according to the second embodiment is configured such that the first drive member 90 and the second driver 11, which differ in the portions described in the first embodiment, are incorporated into the lower-portion case 22 in the state illustrated in FIG. 21, so that the snap action mechanism is assembled. The switching device 100 according to the second embodiment differs from the switching device 1 according to the first embodiment, in which the first drive member 90 and the second driver 11 are integrated and then incorporated into the lower-portion case 22, in that the first drive member 90 and the second driver 11 are separately incorporated into the lower-portion case 22.

Hereafter, for the switching device 100 according to the second embodiment, the operation performed when the first drive member 90 and the second driver 11 are incorporated into the lower-portion case 22 in the state illustrated in FIG. 21 will be described. Each of FIGS. 25A to 28B relates to a side view (figure A) of the lower-portion case 22 and a cross-sectional side view (figure B) thereof when the integrated first drive member 90 and second driver 11 are incorporated into the lower-portion case 22 that is held in the state illustrated in FIG. 21.

Figure 25A:
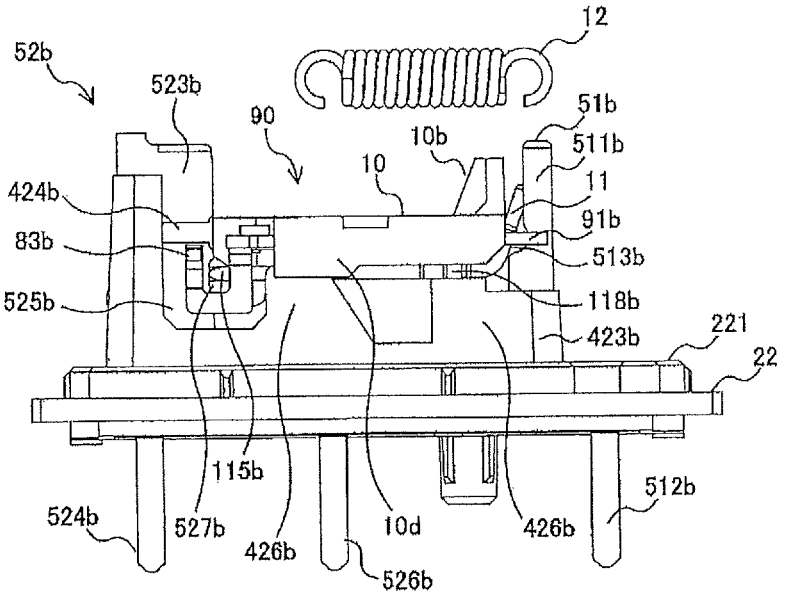
FIGS. 25A and 25B are a side view and cross-sectional side view of the lower-portion case when the integrated first drive member and second driver are incorporated into the lower-portion case that is held in the state illustrated in FIG. 21.
Figure 25B:
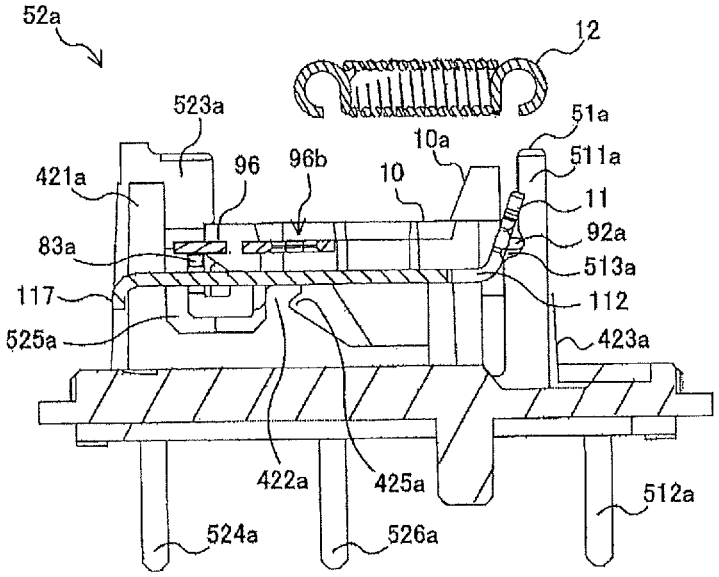

When the first drive member 90 and the second driver 11 are incorporated into the lower-portion case 22 in the state illustrated in FIG. 21, as illustrated in FIGS. 25A and 25B, first, the second driver 11 is mounted on the supports 4*a* and 4*b*, and the first drive member 90 is mounted. In this case, for the second driver 11, the protruding pieces 114*a* and 114*b* serving as second mounting portions, are mounted on the respective upper surfaces of the protruding pieces 422*a* and 422*b*, and the protruding pieces 118*a* and 118*b*, which serve as first mounting portions, are mounted on the respective upper surfaces of the supporting portions 426*a* and 426*b*. Further, the second driver 11 is disposed in a state in which tips of the fulcrums 115*a* and 115*b* are respectively accommodated in the recessed portions 527*a* and 527*b* as receiving portions, which are formed in the second transfer contacts 522*a* and 522*b*. At this time, the space 116*a* of the second driver 11 is held in a state of accommodating the contact portions 83*a* inside of the movable contact 8*a*, and the space 116*b* of the second driver 11 is held in a state of accommodating the contact portions 83*b* inside of the movable contact 8*b*.

The first drive member 90 is mounted parallel to the second driver 11 mounted on the lower-portion case 22 described above. In this case, the first drive member 90 is disposed in a state in which the fulcrums 92*a* and 92*b* are respectively accommodated in the recessed portions 513*a* and 513*b*, which are formed in the common contacts 51*a* and 51*b*, and in which the guiding portions 10*c* and 10*d* are respectively disposed outside of the supporting portions 426*a* and 426*b*.

The extension spring 12 is attached to the first drive member 90 and the second driver 11 that are arranged in the above manner. Specifically, the extension spring 12 is attached such that one end of the extension spring 12 is locked to the hole 96*b* of the reinforcement member 96 that constitutes part of the first drive member 90, while the other end of the extension spring 12 is locked to the opening 112 of the second driver 11. In this case, the extension spring 12 is attached from the upper side of the first drive member 90 that is stacked on the second driver 11. In other words, the extension spring 12 is attached in a state in which the first drive member 90 and the second driver 11 are positioned in parallel. Thus, the extension spring 12 can be attached without preparing a jig or the like, which holds the first drive member 90 and the second driver 11 in a predetermined state. Accordingly, operational efficiency in the assembly operation for the snap action mechanism 7 can be improved. Note that FIGS. 25A and 25B illustrate the state before the extension spring 12 is attached.

Figure 26A:
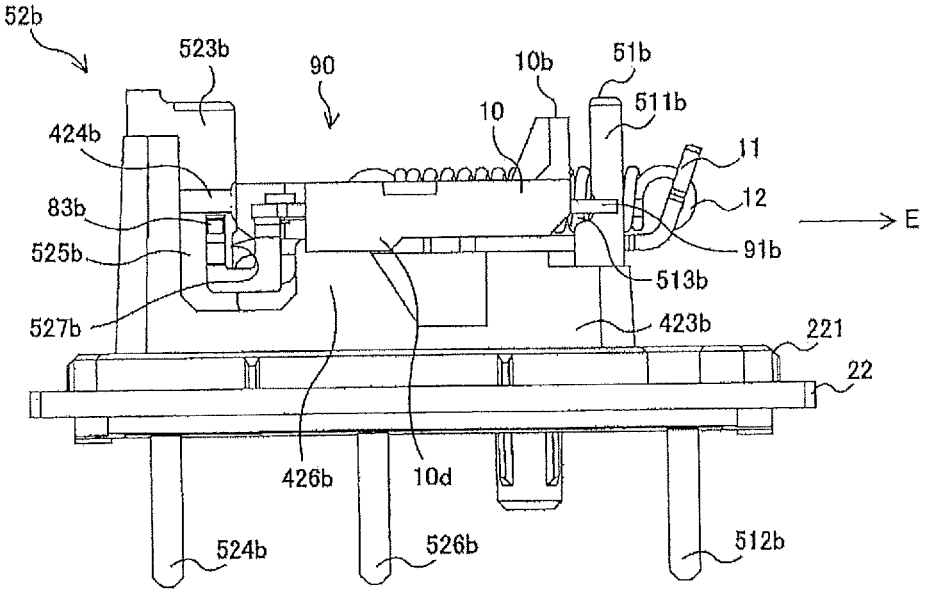
FIGS. 26A and 26B are a side view and cross-sectional side view of the lower-portion case when the integrated first drive member and second driver are incorporated into the lower-portion case that is held in the state illustrated in FIG. 21.
Figure 26B:
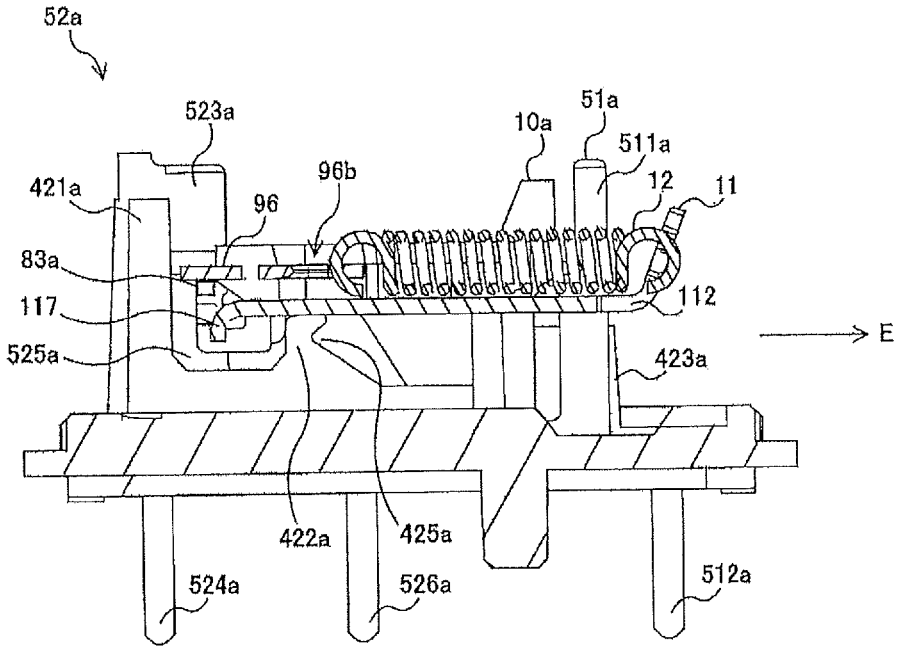

After the extension spring 12 is attached to the first drive member 90 and the second driver 11 that are held in the state illustrated in FIGS. 25A and 25B, while the first drive member 90 is held downward with a hand, as illustrated in FIGS. 26A and 26B, the second driver 11 acting against the bias force of the extension spring 12, is pushed toward the common contacts 51*a* and 51*b*, e.g., in the direction represented by the arrow E illustrated in FIGS. 26A and 26B. In this case, the fulcrums 92*a* and 92*b* are accommodated in the respective recessed portions 513*a* and 513*b* and thus the first drive member 90 is maintained in the state illustrated in FIGS. 25A and 25B, so that only the second driver 11 is moved. At this time, the second driver 11 is moved in a state in which the protruding pieces 114*a* and 114*b* are in sliding contact with the respective upper surfaces of the protruding pieces 422*a* and 422*b*. When the second driver 11 is moved in the direction represented by the arrow E, the fulcrums 115*a* and 115*b* exit the respective recessed portions 527*a* and 527*b*, so that the second driver 11 is held at a state of being retracted to the right side as illustrated in FIGS. 26A and 26B.

Then, the protruding pieces 114*a* and 114*b* respectively move to positions reaching the right side as illustrated in FIGS. 26A and 26B, relative to the upper surfaces of the protruding pieces 422*a* and 422*b*. Then, the end portion of the contact piece 117 of the second driver 11 is moved downward. At this time, the end portion of the contact piece 117 of the second driver 11 is moved downward, while the second driver 11 is slightly moved to the left side illustrated in FIGS. 26A and 26B, in accordance with the biasing force of the extension spring 12. In such a manner, the fulcrums 115*a* and 115*b* of the second driver 11 are respectively disposed at the recessed portions 425*a* and 425*b* of the protruding pieces 422*a* and 422*b* (see FIG. 27B). At this time, the right-side end portion of the second driver 11 is held in a slightly upward-extending state, and the right-side end portion of the extension spring 12 is also held in a slightly upward-extending state.

Figure 27A:
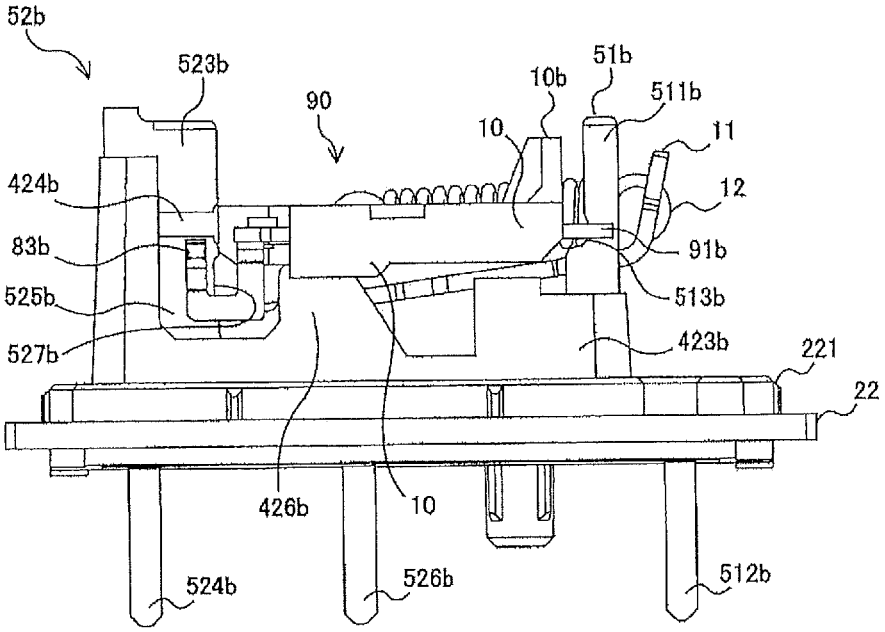
FIGS. 27A and 27B are a side view and cross-sectional side view of the lower-portion case when the integrated first drive member and second driver are incorporated into the lower-portion case that is held in the state illustrated in FIG. 21.
Figure 27B:
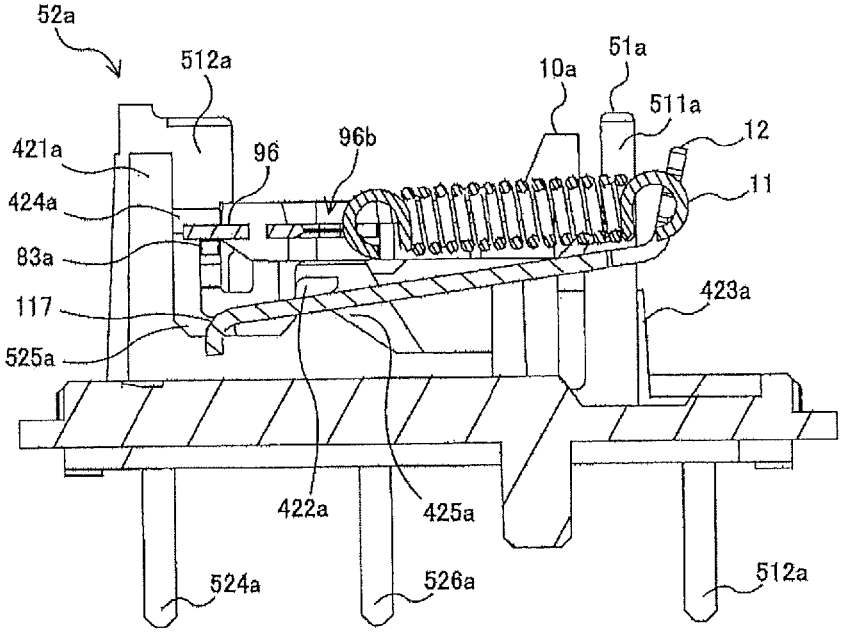
Figure 28A:
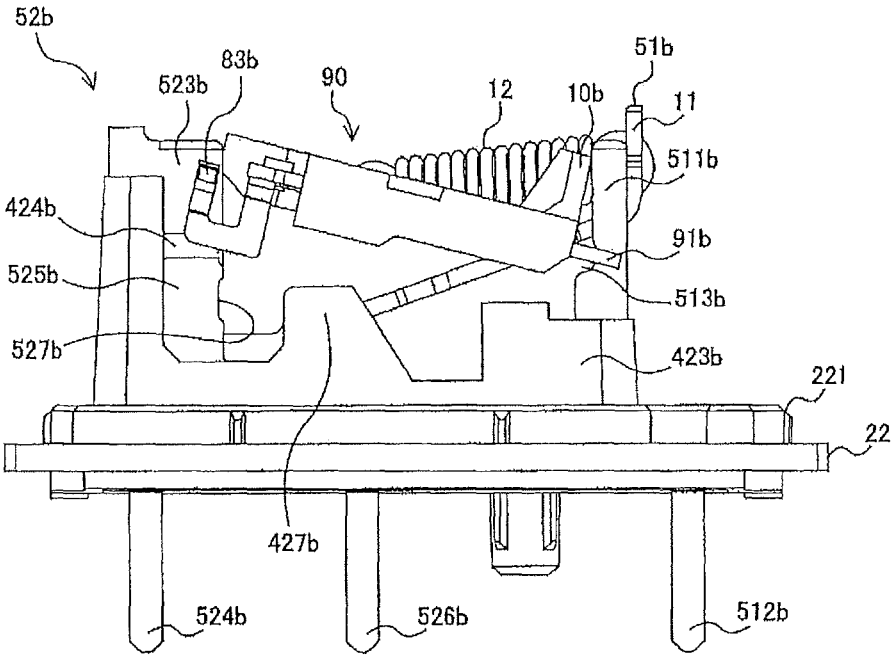
FIGS. 28A and 28B are a side view and cross-sectional side view of the lower-portion case when the integrated first drive member and second driver are incorporated into the lower-portion case that is held in the state illustrated in FIG. 21.
Figure 28B:
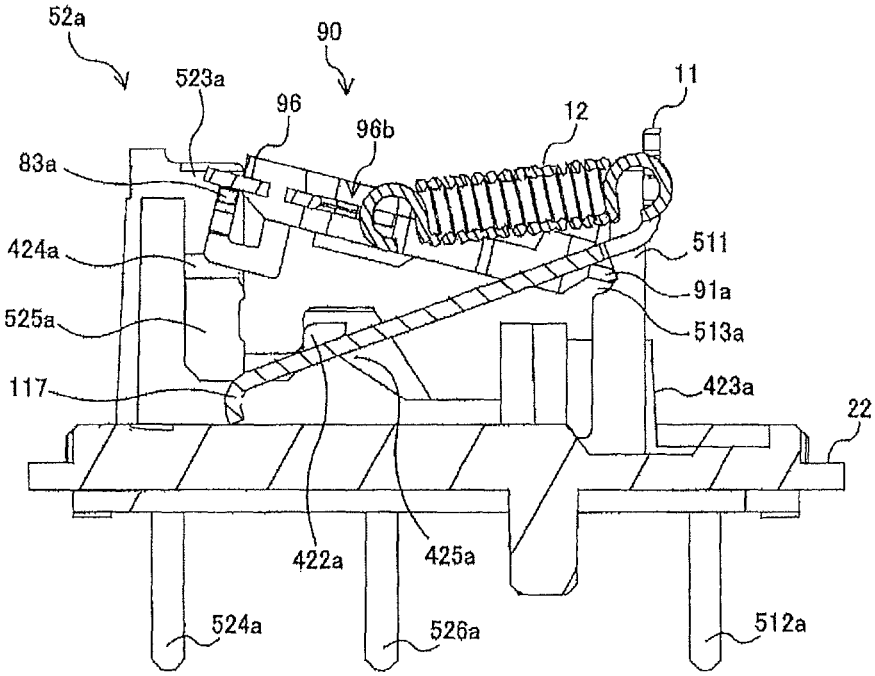

In the state illustrated in FIGS. 27A and 27B, when the hand holding the first drive member 90 is released, the left side portion of the first drive member 90 is lifted by the biasing force of the extension spring 12. In this case, as illustrated in FIG. 28A, the first drive member 90 is lifted to a position where the contact pieces 10*a* and 10*b* provided on the upper surface of the coupling member 10 contact the respective contact portions 511*a* and 511*b* of the common contacts 51*a* and 51*b*, so that the first drive member 90 is held in a rest state and at a position where the contact pieces are contacted. As illustrated in FIG. 28B, the second driver 11 is held in a state in which the contact piece 117 contacts the lower surface of the lower-portion case 22, and thus the second driver 11 is restricted from rotating further. As described above, the rotation of the first drive member 90 is restricted by the contact pieces 10*a* and 10*b*, the rotation of the second driver 11 is restricted by the contact piece 117, and in the process of the assembly operation, the first drive member 90 and the second driver 11 can be retained in a stable state. At this time, the left-side end portion of the first drive member 90 is held in a slightly upward-extending state.

When the first drive member 90 becomes in the state illustrated in FIGS. 28A and 28B, the first drive member 90 and the second driver 11, to which the biasing force to attract to each other is applied by the extension spring 12, are each rotatably retained at given fulcrums from among the fulcrums 92*a* and 92*b*, which contact the recessed portions 513*a* and 513*b*, and the fulcrums 115*a* and 115*b* that contact the recessed portions 425*a* and 425*b*. In the switching device 100 according to the second embodiment, the snap action mechanism 7 is constituted by the first drive member 90, the second driver 11, and the extension spring 12, which are in the state of being incorporated into the lower-portion case 22 as described above.

As described above, in the method of assembling the snap action mechanism 7 provided in the switching device 100 according to the second embodiment, each of the second driver 11 and the first drive member 90 is mounted on the supports 4*a* and 4*b*, and the extension spring 12 is attached to both of the second driver 11 and the first drive member 90. Then, by simply disposing the fulcrums 115*a* and 115*b* of the second driver 11 at the respective recessed portions 425*a* and 425*b* of the protruding pieces 422*a* and 422*b*, the first drive member 90 and the second driver 11 can be incorporated at predetermined locations of the housing 2. Accordingly, the snap action mechanism 7 can be assembled without any need for complicated operations.

Figure 29:
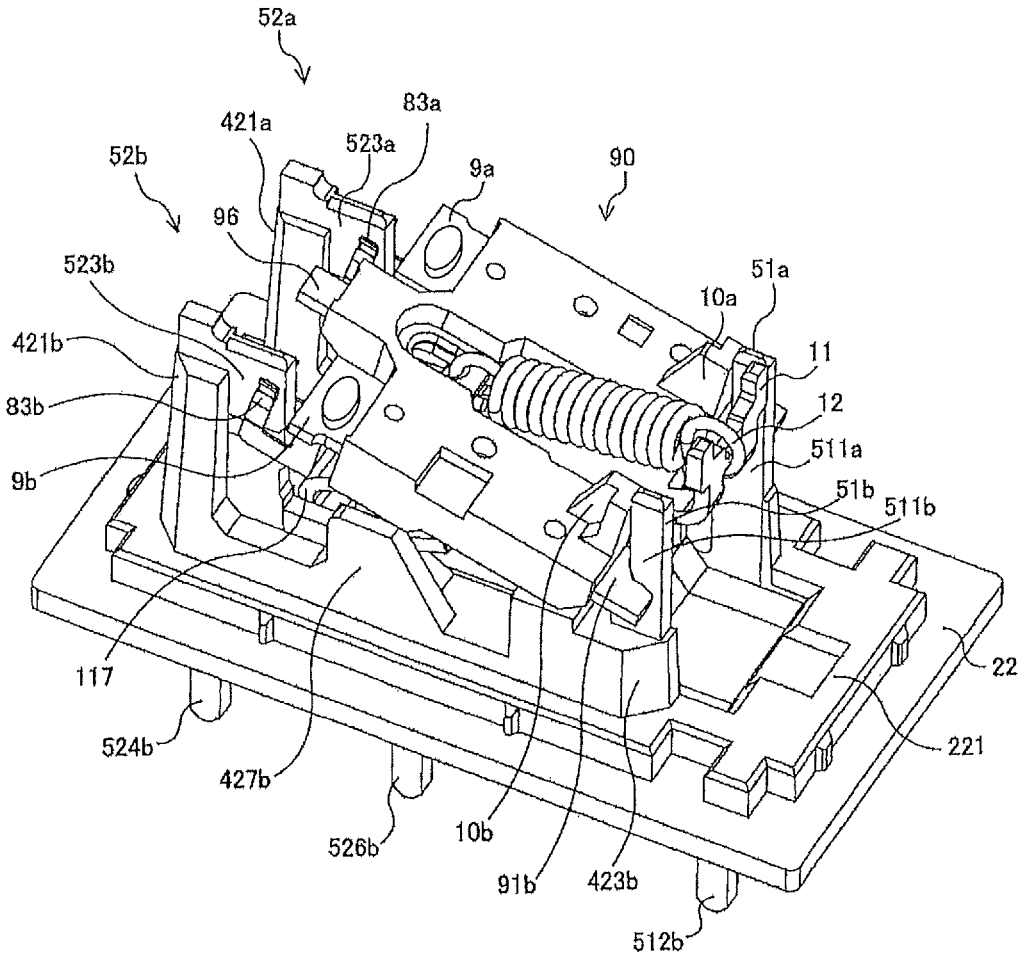
FIG. 29 is a perspective view of the lower-portion case into which the snap action mechanism is incorporated in the switching device according to the second embodiment.
Figure 30:
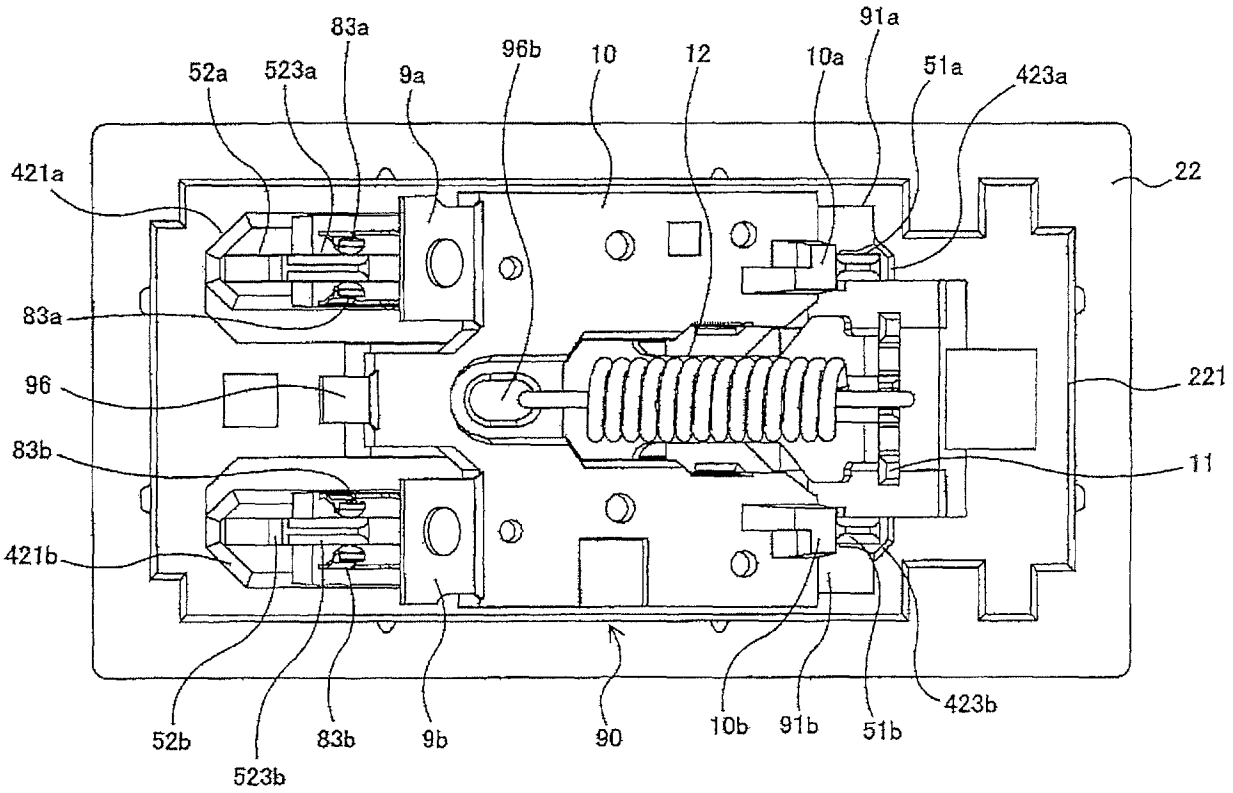
FIG. 30 is a top view of the lower-portion case into which the snap action mechanism is incorporated in the switching device according to the second embodiment.
Figure 31B:
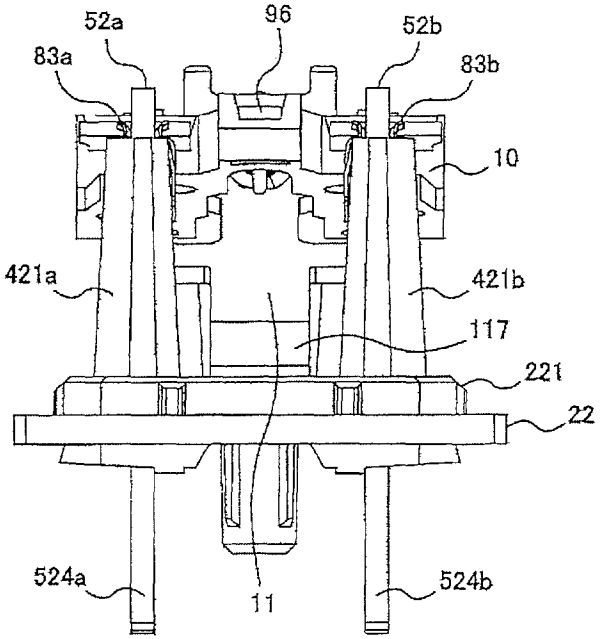
FIGS. 31A and 31B are side views of the lower-portion case into which the snap action mechanism is incorporated in the switching device according to the second embodiment.
Figure 31A:
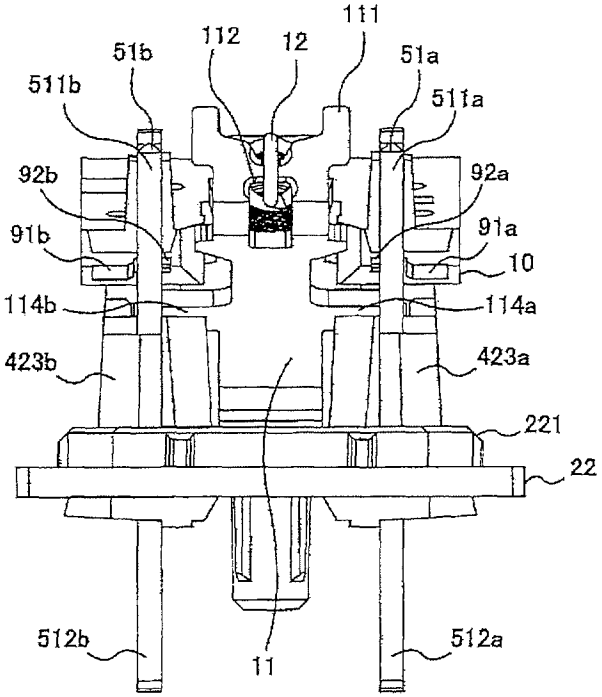

Hereafter, with reference to FIGS. 28A and 28B, the configuration of the lower-portion case 22 into which the snap action mechanism 7 is incorporated will be described using FIGS. 29 to 31. FIGS. 29 and 30 are a perspective view and top view of the lower-portion case 22 into which the snap action mechanism 7 is incorporated, in the switching device 100 according to the second embodiment. FIG. 31 is a side view of the lower-portion case 22 into which the snap action mechanism 7 is incorporated, in the switching device 100 according to the second embodiment. FIG. 31A is a side view from the right side illustrated in FIG. 30. FIG. 31B is a side view from the left side illustrated in FIG. 30.

As illustrated in FIGS. 28A, 28B, and 29, in a state of being incorporated into the lower-portion case 22, the first drive member 90 is retained in a state of being oriented upward with respect to the left side illustrated in the figures, while the second driver 11 is retained in a state of being oriented upward with respect to the right side illustrated in the figures. The movable contacts 8*a* and 8*b*, each of which is disposed on the lower surface of the first drive member 90, extend on the left upper sides illustrated in FIGS. 28A, 28B, and 29, and the contact portions 83*a* and 83*b* of the movable contacts 8*a* and 8*b* are in sliding contact with the respective slide contact portions 523*a* and 523*b* of the transfer contacts 52*a* and 52*b*. The contact pieces 10*a* and 10*b* provided on the upper surface of the first drive member 90 contact the respective common contacts 51*a* and 51*b*, to thereby restrict the rotation of the first drive member 90. The contact piece 117 of the second driver 11 contacts the upper surface of the lower-portion case 22, to thereby become in a stage of restricting the rotation of the second driver 11.

As illustrated in FIGS. 30 and 31, the fixed contacts 5*a* and 5*b* (common contacts 51*a* and 51*b* and transfer contacts 52*a* and 52*b*) are at a predetermined distance from the lower-portion case 22, and are arranged side by side. For the first drive member 90, the first drivers 9*a* and 9*b* are disposed at respective locations corresponding to the fixed contacts 5*a* and 5*b*, and the movable contacts 8*a* and 8*b* are disposed at locations at each of which a given transfer contact from among the transfer contacts 52*a* and 52*b* is sandwiched. The second driver 11 is disposed below the first drive member 90 to pass along the middle portion of the first drive member, and is connected to the hole 96*b* provided in the reinforcement member 96, through the extension spring 12.

Figure 32:
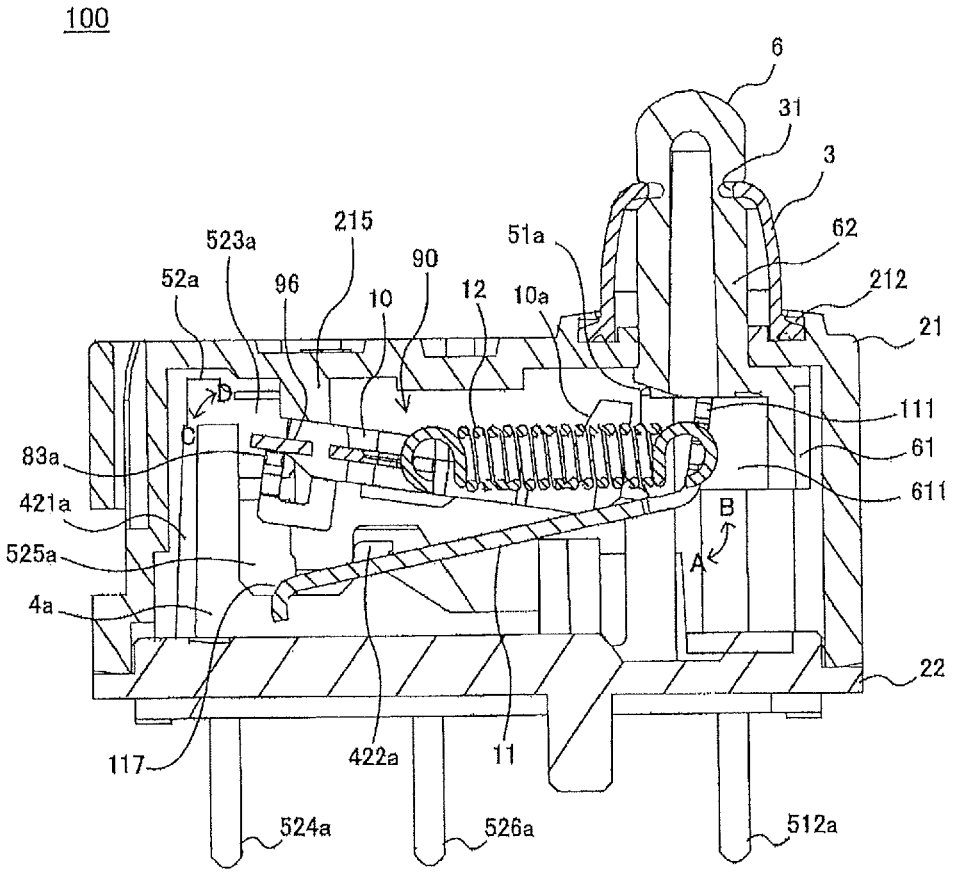
FIG. 32 is a cross-sectional side view of the switching device for explaining the internal configuration thereof according to the second embodiment.

In the switching device 100 according to the second embodiment, the upper-portion case 21 is attached to the lower-portion case 22 into which the snap action mechanism 7 is incorporated as described above, in a state in which the operation member 6 is accommodated in the accommodating portion. Hereafter, the internal configuration of the switching device 100 according to the second embodiment will be described. FIG. 32 is a cross-sectional side view of the switching device 100 for explaining the internal configuration thereof according to the second embodiment.

As illustrated in FIG. 32, the operation member 6 is disposed at the accommodating portion in the housing 2, in a state in which the pressed portion 111 of the second driver 11 is accommodated in the accommodating portion 611 provided at the lower surface of the pressing portion 61, and in which the shaft portion 62 is inserted through the opening 211. The cover 3 attached to the groove 212 is attached to the outer periphery of the lower end portion of the shaft portion 62 protruding from the opening 211. Note that the upper end portion of the shaft portion 62 is in a state of protruding from the hole 31 of the cover 3.

The protruding wall 215 is provided at a predetermined location of the inner wall (top surface) of the upper-portion case 21, as in the case with the switching device 1 according to the first embodiment. The protruding wall 215 is disposed on or above the coupling member 10 of the first drive member 90, contacts the upper surface (upper surface of the coupling member 10) of the first drive member 90 in an initial state, and serves as a stopper for rotation of the first drive member 90. Note that unlike the switching device 1 according to the first embodiment, the switching device 100 according to the second embodiment does not include the protruding walls 213*a* and 214*a* on the inner wall surface of the upper-portion case 21. However, these protruding walls may be provided.

In the switching device 100 according to the second embodiment, when the press operation is performed through the operation member 6 disposed on the pressed portion 111, the switching device 100 operates in the same manner as the switching device 1 according to the first embodiment. In other words, in response to pushing the pressed portion 111 downward, while acting against the biasing force of the extension spring 12, the second driver 11 rotates in the direction represented by the arrow A, where the fulcrums 115*a* and 115*b* are used as pivotal points. In contrast, when the press operation through the operation member 6 is canceled, the second driver 11 rotates in the direction represented by the arrow B, in accordance with the biasing force of the extension spring 12, where the fulcrums 115*a* and 115*b* are used as pivotal points. In this case, in accordance with the location at which the second driver 11 is rotated, the first drive member 90 rotates in the direction represented by the arrow C or D, where the fulcrums 92*a* and 92*b* are used as pivotal points.

Figure 33:
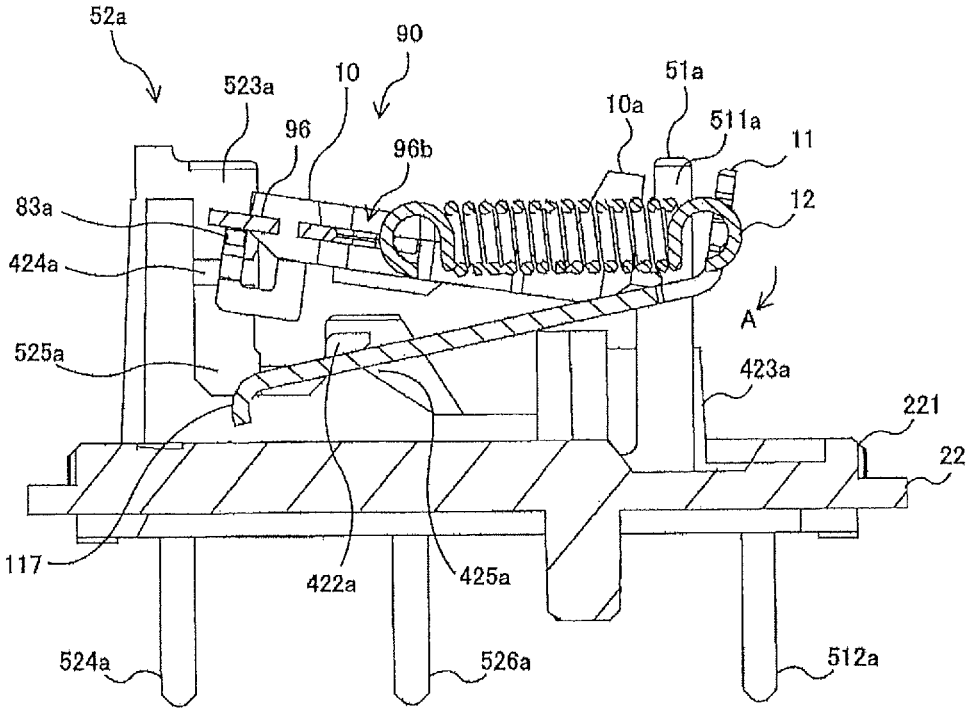
FIG. 33 is a side view of the switching device for explaining the operation associated with the press operation according to the second embodiment.
Figure 34:
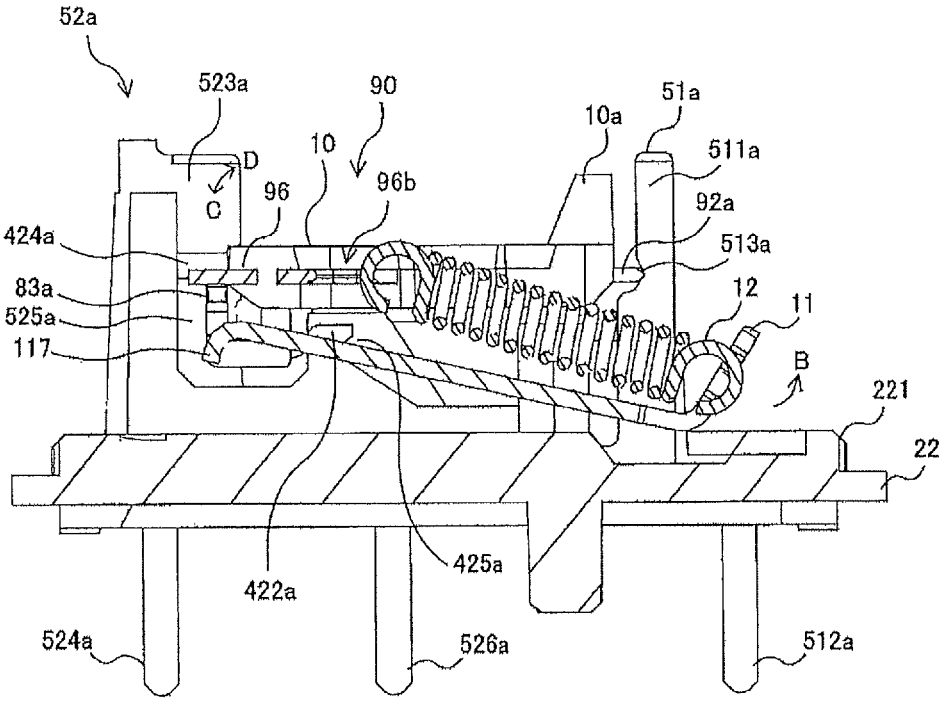
FIG. 34 is a side view of the switching device for explaining the operation associated with the press operation according to the second embodiment.

Hereafter, the operation associated with the press operation through the operation member 6 in the switching device 100 according to the second embodiment will be described. FIGS. 33 and 34 are side views of the switching device 100 for explaining the operation associated with the press operation according to the second embodiment. Note that in FIGS. 33 and 34, the upper-portion case 21, the cover 3, and the operation member 6 are omitted for the sake of explanation.

In a state (initial state) in which the press operation is yet to be performed through the operation member 6, the switching device 100 is held in the state illustrated in FIG. 33. The movable contacts 8*a* and 8*b* extend on the left upper side illustrated in FIG. 33. The slide contact portion 523*a* of the transfer contact 52*a* is sandwiched between the contact portions 83*a* of the movable contact 8*a*, and the contact portions 83*a* are in sliding contact with the slide contact portion 523*a*. The slide contact portion 523*b* of the transfer contact 52*b* is sandwiched between the contact portions 8*b* of the movable contact 8*b*, and the contact portions 83*b* are in sliding contact with the slide contact portion 523*b*. In this case, the circuits each of which has a given first transfer contact from among the first transfer contacts 521*a* and 521*b* as normally closed contacts and has a given common contact from among the common contacts 51*a* and 51*b*, are in a conductive state.

When the press operation is performed through the operation member 6 and the pressed portion 111 is pushed downward, the second driver 11 rotates in the direction represented by the arrow A while acting against the biasing force of the extension spring 12, where the fulcrums 115*a* and 115*b* are used as pivotal points. However, until the second driver 11 is rotated to a predetermined limit position, the first drive member 90 remains in a rest state, at an initial position (position illustrated in FIG. 33). Thus, the contact portions 83*a* and 83*b* of the movable contacts 8*a* and 8*b* are respectively maintained in sliding contact with the slide contact portions 523*a* and 523*b*.

Then, when the second driver 11 is rotated to the predetermined limit position, the direction in which the biasing force of the extension spring 12 is applied to the first drive member 90 and the second driver 11 is reversed, and the first drive member 90 is pulled downward. Thus, as illustrated in FIG. 34, the first drive member 90 immediately rotates in the direction represented by the arrow C, where the fulcrums 92*a* and 92*b* are used as pivotal points. In this case, the contact portions 83*a* and 83*b* of the movable contacts 8*a* and 8*b* pass the insulating piece 424*b*, and are in sliding contact with the slide contact portions 525*a* and 525*b*. Thus, the circuits each of which has a given second transfer contact from among the second transfer contacts 522*a* and 522*b* as normally opened contacts, and each of which has a given common contact from among the common contacts 51*a* and 51*b*, are changed over to a conductive state. In this case, the movable contacts 8*a* and 8*b* are provided in the respective first drivers 9*a* and 9*b* that are coupled by the coupling member 10. For this reason, the respective movable contacts 8*a* and 8*b* slide with respect to the transfer contacts 52*a* and 52*b*, at substantially the same timing, and are in sliding contact with the slide contact portions 525*a* and 525*b*.

In contrast, when the press operation through the operation member 6 is canceled, the second driver 11 rotates in the direction represented by the arrow B, in accordance with the biasing force of the extension spring 12, where the fulcrums 115*a* and 115*b* are used as pivot points. However, until the second driver 11 is rotated to a predetermined limit position, the first drive member 90 remains held in a rest state, at the position illustrated in FIG. 34. Thus, the contact portions 83*a* and 83*b* of the movable contacts 8*a* and 8*b* are maintained in sliding contact with the respective slide contact portions 525*a* and 525*b*.

When the second driver 11 is rotated to the predetermined limit position, the direction in which the biasing force of the extension spring 12 acts on the first drive member 90 and the second driver 11 is reversed, and the first drive member 90 is pulled upward through the extension spring 12, the first drive member 90 is immediately rotated in the direction represented by the arrow D, where the fulcrums 92*a* and 92*b* are used as pivot points. Accordingly, the first drive member 90 returns to the initial position (see FIG. 33). In this case, the contact portions 83*a* and 83*b* of the movable contacts 8*a* and 8*b* pass the insulating piece 424*b*, and are in sliding contact with the respective slide contact portions 523*a* and 523*b*. In such a manner, the circuits each of which has a first transfer contact from among the first transfer contacts 521*a* and 521*b* as normally closed contacts, and each of which gas a given common contact from among the common contacts 51*a* and 51*b*, are each changed over to a conductive state. In this case as well, the respective movable contacts 8*a* and 8*b* slide with respect to the transfer contacts 52*a* and 52*b* at substantially the same timing, and are in sliding contact with the contact portions 523*a* and 523*b*.

As described above, the switching device 100 according to the second embodiment includes the snap action mechanism 7 that drives the first drive member 90 including the movable contacts 8*a* and 8*b*. Thus, when the operation member 6 is pressed to a predetermined limit position, the movable contacts 8*a* and 8*b* provided on the integrally coupled first drivers 9*a* and 9*b* can be operated immediately in accordance with the biasing force of the extension spring 12. Accordingly, when a plurality of circuits are synchronized and changed over, variation in a synchronization timing at which the circuits are changed over can be reduced.

Note that the present disclosure is not limited to the above embodiments, and various modifications to the embodiments can be made to carry out the present disclosure. In the above embodiments, the size, shape, and the like illustrated in the accompanied drawings are not limited thereto, and can appropriately vary within a scope in which the effect of the present disclosure is obtained. Further, other conditions can appropriately vary to carry out the present disclosure as long as they do not depart from a scope for meeting the objective of the present disclosure.

For example, the above embodiments have been described using the case where the first drive member 90 includes two first drivers 9*a* and 9*b*. However, the number of first drivers 9 is not limited to the above number, and three or more first drivers 9 may be provided corresponding to the number of target circuits to be changed over. Note that in this case, the number of movable contacts 8 is preferably provided correspondingly to the number of first drivers 9. In such a manner, when the number of first driver 9 is increased, the same effect as that described in the above embodiments can be obtained.

In the above embodiments, each of the movable contacts 8*a* and 8*b* has the shape of which two sides are in sliding contact with a given transfer contact. However, each movable contact according to the present disclosure may have the shape of which a single side is in sliding contact with a given transfer contact.

The above embodiments provide a method of assembling the snap action mechanism 7 that includes the first drive member 90, which is configured such that the first drivers 9*a* and 9*b* are coupled by the coupling member 10, and that includes the second driver 11. However, a method of assembling the snap action mechanism 7 according to the present disclosure is not limited to assembling using the snap action mechanism 7 having the components described above, and can be appropriately modified. For example, a snap action mechanism 7 including a single first driver 9 and a second driver 11, or a snap action mechanism 7 including a movable contact 8 having a shape other than a clip shape, can also be adopted. In such a manner, even when such a snap action mechanism 7 including the single first driver 9 and the second driver 11 is adopted, the snap action mechanism 7 can be easily assembled without requiring complicated operations, as in the above described embodiments.

Further, the above embodiments provide the case where the fixed contacts 5 include the common contacts 51*a* and 51*b* as normally closed contacts, and includes the second transfer contacts 522*a* and 522*b* as normally opened contacts. However, the configuration of the fixed contacts 5*a* and 5*b* are not limited to the configuration described above, and can be modified appropriately. For example, for the configuration of the common contacts 51*a* and 51*b*, common contacts are not provided, and when each common contact is operated as normally open, two contacts that are the fixed contacts 5*a* and 5*b* may become conductive.

What is claimed is:

1. A switching device comprising:

a housing including an accommodating portion;

an operation member through which a press operation is performed;

a plurality of fixed contacts juxtaposed at a predetermined interval in the accommodating portion;

a plurality of movable contacts each including at least one contact portion that is in sliding contact with a given fixed contact from among the fixed contacts; and a snap action mechanism for causing the movable contacts to operate in response to a pressing of the operation member to a predetermined position, wherein the snap action mechanism includes:

a plurality of first drivers in each of which a fulcrum that serves as a pivot point is formed on one end side of a given first driver and in which a given movable contact from among the movable contacts is provided on another end side of the given first driver;

a second driver in which a pressing portion to be pressed through the operation member is formed on one end side of the second driver and in which fulcrums that serve as pivot points are each formed on another end side of the second driver;

a coupling member integrally coupling the plurality of first drivers to constitute a first drive member; and an extension spring of which both one end is attached to a portion of the first drive member and another end is attached to a portion of the second driver, and wherein the coupling member includes clamping portions each of which passes through holes provided through a given first driver and a given movable contact and each of which clamps the given first driver and the given movable contact.

2. The switching device according to claim 1, wherein the coupling member is formed of a liquid crystal polymer (LCP) resin.

3. The switching device according to claim 1, wherein the hole provided in each movable contact is a slot extending in a longitudinal direction of a given movable contact.

4. The switching device according to claim 1, wherein each movable contact includes a pair of pieces, contact portions being provided at respective tips of the pair of pieces, and wherein each movable contact has a given hole provided at a portion at which the pair of pieces are coupled.

5. The switching device according to claim 1, wherein each clamping portion includes a first stopper to cover the hole of a given movable contact, a second stopper to cover the hole of a given first driver, and a connection portion that is inserted in a hole of the first stopper and a hole of the second stopper and that connects the first stopper and the second stopper.

6. The switching device according to claim 1, further comprising a reinforcement member that is embedded in the coupling member in a state in which a portion of the reinforcement member is exposed, one end of the extension spring being attached to an exposed portion of the reinforcement member.

7. The switching device according to claim 6, wherein each first driver includes a conductor plate in which a given fulcrum is formed, and includes a given movable contact attached to the conductor plate, a portion of the movable contact at which the conductor plate is attached being embedded in the coupling member.

8. The switching device according to claim 7, wherein the reinforcement member is constituted by a portion of the conductor plate.

9. The switching device according to claim 7, wherein a material of the conductor plate and a material of the movable contact are different, and the material of the conductor plate has greater stiffness than the material of the movable contact.

10. The switching device according to claim 1, wherein a pair of pieces of each movable contact is coupled on a side of a given first driver, contact portions are provided at respective tips of the pair of pieces opposing the given first driver, and portions of the pair of pieces of each movable contact at which the contact portions are provided extend upward, the portions being disposed to face each other.

11. The switching device according to claim 1, wherein the extension spring is attached to the portion of the first drive member and the portion of the second driver, at a location between first drivers that are situated next to each other.

12. The switching device according to claim 1, further comprising engagement means that is constituted by a portion of the first drive member and a portion of the second driver, the engagement means being for engaging the first drive member and the second driver in accordance with a biasing force of the extension spring, to integrate the first drive member and the second driver.

13. The switching device according to claim 1, further comprising protruding walls provided on an inner wall of the housing, toward a direction in which spring load of the extension spring is applied to a common contact of a given fixed contact provided upward in the accommodating portion, each protruding wall being adjacent to and facing a tip of the common contact.

14. The switching device according to claim 1, wherein each fixed contact is disposed at a location further than a location at which a given fulcrum of the second driver is disposed, relative to a location at which the fulcrum of a given first driver is disposed.

15. The switching device according to claim 1, wherein a lower surface of the coupling member of the first drive member, and a support disposed in the housing contact each other, so that the first drive member is restricted from rotating downward due to spring load of the extension spring.

16. The switching device according to claim 1, wherein an upper surface of the coupling member of the first drive member, and the housing contact each other, so that the first drive member is restricted from rotating upward due to spring load of the extension spring.

17. The switching device according to claim 1, wherein the second driver includes mounting portions each allowing for mounting on a support provided in the housing, in an assembly operation, and wherein each fulcrum is formed on an end portion of a given mounting portion from among the mounting portions.

18. The switching device according to claim 17, further comprising a receiving portion provided in a transfer contact of each fixed contact, the receiving portion being for allowing arrangement of a given fulcrum of the second driver in an assembly operation.

19. The switching device according to claim 17, wherein the mounting portions include first mounting portions each of which is on a side of a common contact of a given fixed contact, and include second mounting portions each of which is on a side of a transfer contact of a given fixed contact, each second mounting portion being formed to be longer than the first mounting portion in a direction from the common contact to the transfer contact.

20. The switching device according to claim 17, wherein the first drive member includes a rotation restriction that contacts a common contact of a given fixed contact so that rotation due to spring load of the extension spring is restricted in the assembly operation, and wherein the second driver includes a rotation restriction that contacts the housing so that the rotation due to spring load of the extension spring is restricted in the assembly operation.

* * * * *